US007011536B2

(12) United States Patent
Okamoto et al.

(10) Patent No.: US 7,011,536 B2
(45) Date of Patent: Mar. 14, 2006

(54) CONNECTOR AND A CONNECTOR ASSEMBLY

(75) Inventors: Michiaki Okamoto, Yokkaichi (JP); Hiroyuki Matsuoka, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 9 days.

(21) Appl. No.: 10/731,844

(22) Filed: Dec. 9, 2003

(65) Prior Publication Data

US 2004/0121640 A1 Jun. 24, 2004

(30) Foreign Application Priority Data

Dec. 12, 2002 (JP) ..... 2002-361201
Dec. 13, 2002 (JP) ..... 2002-362670

(51) Int. Cl.
*H01R 13/62* (2006.01)

(52) U.S. Cl. ..... 439/157; 439/347

(58) Field of Classification Search ..... 439/157, 439/152, 160, 310, 595, 594, 347
See application file for complete search history.

(56) References Cited

U.S. PATENT DOCUMENTS 5,326,274 A 7/1994 Pfaff et al. ..... 439/157
5,391,086 A * 2/1995 Woller et al. ..... 439/157
5,478,251 A * 12/1995 Jaklin ..... 439/157
5,575,676 A * 11/1996 Tsukakoshi et al. ..... 439/347
5,672,067 A 9/1997 Ryll et al. ..... 439/157
5,681,184 A * 10/1997 Pamart et al. ..... 439/595
5,876,226 A 3/1999 Tsukakoshi et al. ..... 439/157
6,113,407 A * 9/2000 Martin ..... 439/205
6,155,850 A 12/2000 Martin et al. ..... 439/157
6,200,164 B1 3/2001 Martin et al. ..... 439/595

FOREIGN PATENT DOCUMENTS

| | | |
|---|---|---|
| JP | 6-2577 | 6/1994 |
| JP | 8-315913 | 11/1996 |
| JP | 9-92367 | 4/1997 |
| JP | 2002-313482 | 10/2002 |
| JP | 2002-359031 | 12/2002 |
| JP | 2002-373731 | 12/2002 |

* cited by examiner

*Primary Examiner*—Hien Vu
(74) *Attorney, Agent, or Firm*—Gerald E. Hespos; Anthony J. Casella

(57) ABSTRACT

One 20 of a pair of connector housings 10, 20 connectable with each other is provided with a slider 40. The other connector housing 10 is provided with main follower pins 17 and auxiliary follower pins 18 located at different positions from the main follower pins 17. The slider 40 is formed with main cam grooves 44 for guiding the main follower pins 17 until the connection of the two connector housings 10, 20 is completed and auxiliary cam grooves 48 engageable with the auxiliary follower pins 18 at a desired timing within a period from an intermediate stage of the connection of the two connector housings 10, 20 to a completing timing of the connection.

7 Claims, 34 Drawing Sheets

CONNECTOR AND A CONNECTOR ASSEMBLY

BACKGROUND OF THE INVENTION

1. Field of the Invention

The invention relates to a connector and a connector assembly connectable and separable using a cam mechanism.

2. Description of the Related Art

U.S. Pat. No. 6,113,407 discloses a slider type connector with first and second housings that are connectable with each other. A slider is mounted on the first housing and is movable in a direction that intersects a connecting direction of the housings. The slider is formed with cam grooves and the second housing includes follower pins that are engageable with the cam grooves of the slider. The slider initially is at a retracted position, and the follower pins face the entrances of the cam grooves. The slider then is moved forward. As a result, the follower pins are displaced along the cam grooves and the two housings are connected.

The above-described slider-type connector has a plurality of pairs of cam grooves and follower pins are arranged along advancing and retracting directions of the slider. Thus, the length of the slider is restricted. As a result, the length of each cam groove invariably becomes shorter and an angle of inclination of each cam groove to the connecting direction becomes larger. Specifically, there is a shorter displacement of the slider from the start of the connection, where the follower pins are at the entrances of the cam grooves, to the end of the connection, where the follower pins are at the back ends of the cam grooves. Consequently, the pushed state of the slider cannot be confirmed easily by the eyes and a larger force is required for the connection. Accordingly, an operator may misunderstand that the properly connected state has been reached even though the two housings have not yet reached a proper connection position.

Some slider-type connectors have only one pair of the cam grooves and the follower pins formed along the advancing and retracting directions of the slider. Thus, the cam groove can be long and the angle of inclination of the cam groove to the connecting direction can be smaller. An operation force required for the connecting operation is smaller in this type of the connector. However, a connector with only one pair of cam grooves and follower pins can cause the housings to shake and rotate about the follower pin while being properly connected.

Both types of connectors have advantages and disadvantages, and there has been a demand for a solution to solve these problems rationally.

FIG. 36 shows a connector with a slider 3 formed with cam grooves 2. The slider is mounted on a first housing 1 that is connectable with a second housing (not shown). The slider 3 can advance and retract on the first housing 1 in a direction intersecting a connecting direction of the two housings. Follower pins are provided at the second housing (not shown) and are engageable with the cam grooves 2. The cam grooves 2 are inclined toward a backside with respect to the connecting direction (identified by an arrow in FIG. 36) as they extend from starting ends 2A toward terminus ends 2B. The two housings initially are fit lightly with the slider 3 at a retracted position to bring the follower pins to the entrances of the cam grooves 2. The slider 3 then is advanced. As a result, the follower pins are displaced toward the terminus ends 2B in the cam grooves 2 and the housings are pulled towards each other. The two housings are connected properly when the follower pins reach the terminus ends 2B of the cam grooves 2.

The connector of this type is subjected to a considerable resistance, particularly, at a final stage of the connection of the two housings while the slider 3 is pushed. Thus, a pushing operation may be interrupted halfway and the two housings may be left only partly connected. Further, two properly connected housings may be separated and the slider 3 may be returned to the retracted position if forces act on the housings in separating directions.

The invention was developed in view of the above problems and an object thereof is to provide a connector and connector assembly that have can be connected easily, stably held connected without shaking and/or be prevented from being left partly connected.

SUMMARY OF THE INVENTION

The invention is directed to a connector with first and second housings that are connectable with each other. A slider or other movable member formed with a cam means is mounted on the first housing for movement in a direction intersecting a connecting direction of the two housings. The second housing has a mating cam means that is engageable with the cam means of the movable member. The mating cam means is displaced with respect to the cam means during a period from an initial stage of the connection of the two housings substantially to the completion of the connection as the movable member is moved. As a result, the two housings are connected or separated as the movable member is moved. The connector further includes a holding mechanism at a position different from the position where the mating cam means is engaged with the cam means. The holding mechanism functions for locking the first housing together with the second housing and/or the movable member. The holding mechanism functions in a period from an intermediate stage of the connection of the two housings substantially to the completion of the connection.

The cam means may be a cam groove and the mating cam means may be a follower pin. The follower pin is aligned substantially with the entrance of the cam groove at the initial stage of connecting the housings. The movable member then is operated in this state, for example, by advancing the slider. The connection of the housings proceeds until the housings reach a properly connected state. The holding mechanism acts during the period from the intermediate stage of connecting the housings to the completion of the connection. A locking position of the holding mechanism is different from a position of locking by the follower pin and the cam groove. Thus, the two housings are held in a stable manner that will prevent rotation or other movement after the connection is completed. Additionally, an operation force can be low because the single cam groove can be long and can have a moderate angle of inclination.

The holding mechanism may include an auxiliary follower pin on the second housing at a location spaced from the main follower pin. The holding mechanism may also include an auxiliary cam groove that is disposed on the movable member at a location for engaging the auxiliary follower pin within the period from the intermediate stage of connecting the housings to the completion of the connection.

Accordingly, the main follower pin first aligns substantially with the main cam groove. The movable member then is moved so that the housings are moved towards one another. The auxiliary follower pin enters the auxiliary cam groove in the process of connecting the housings to attain the locked state at the desired time between the intermediate stage of the connection and the completion of the connection. As a result, the housings are prevented from rotating about the main follower pin while being connected with each other.

The auxiliary cam groove preferably is arranged to overlap the main cam groove with respect to an operating direction of the movable member. Accordingly, the main cam groove can have a long length along the operating direction of the movable member. As a result, a force required to operate the movable member is low.

An alternate connector according to the invention also has first and second housings that are connectable with each other. A movable member formed with a cam groove is mounted on the first housing for movement in a direction intersecting a connecting direction of the two housings. The second housing has a follower pin that is engageable with the cam groove of the movable member. The follower pin is displaced from the starting end of the cam groove to the terminus end of the cam groove as the movable member is operated. As a result, the two housings are connected or separated as the movable member is moved. A returning portion is formed near the terminus end of the cam groove and is adapted to displace and/or allow the displacement the housings in separating directions as the follower pin is moved toward the terminus end in the cam groove. Accordingly, forces that act on the housings in separating directions at the final stage of connecting the housings will act to pull the slider. As a result the slider is prevented from stopping at an intermediate position, and the housings are prevented from being left only partly connected. Additionally, forces exerted to separate the properly connected housings only result in the follower pin being pressed against the edge of the cam groove near the terminus end. Thus, the follower pin pushes the slider back to prevent the two housings from being separated.

The cam groove preferably comprises a substantially straight portion that is inclined with respect to the operating direction of the movable member. The returning portion preferably is inclined to the operating direction in a direction opposite to the inclination of the substantially straight portion. Additionally, the cam groove preferably has a peaked portion near the returning portion. An angle of inclination of a front edge of the returning portion preferably is in a range from about 10° to about 5°, and most preferably about 7° to the operating direction of the operable member.

Biasing means preferably are provided for generating forces between the housings to separate the housings in case a connection is interrupted before the housings reach their properly connected state.

A seal preferably is provided to achieve an airtight closure of an inner space between the two properly connected housings. Accordingly, inner pressure increases as the two housings are connected more deeply. Thus, the slider is pulled with a strong force when the follower pin enters the returning portion at the final stage of the connection, and the slider is prevented from stopping at an intermediate position.

An inner pressure of the inner space preferably increases gradually to create biasing forces on the housings in separating directions as the two housings are brought closer to each other.

The biasing forces brought about by the inner pressure of the housings urge the housings in separating directions to pull the movable member when the follower pin has reached the returning portion. Thus, resistance on the movable member suddenly decreases and the movable member is moved to the advanced position with the addition of an inertial force.

These and other features and advantages of the invention will become more apparent upon reading the following detailed description of preferred embodiments and accompanying drawings. Even though embodiments are described separately, single features may be combined to additional embodiments.

DETAILED DESCRIPTION OF THE PREFERRED EMBODIMENTS

FIGS. 1 to 15 show a first embodiment of a connector according to the invention. As shown most clearly in FIGS. 1 to 3, the connector is has a male housing 10 and a female housing 20 that are connectable with each other. The connector also includes a slider 40 mounted on the female housing 20.

Figure 4:
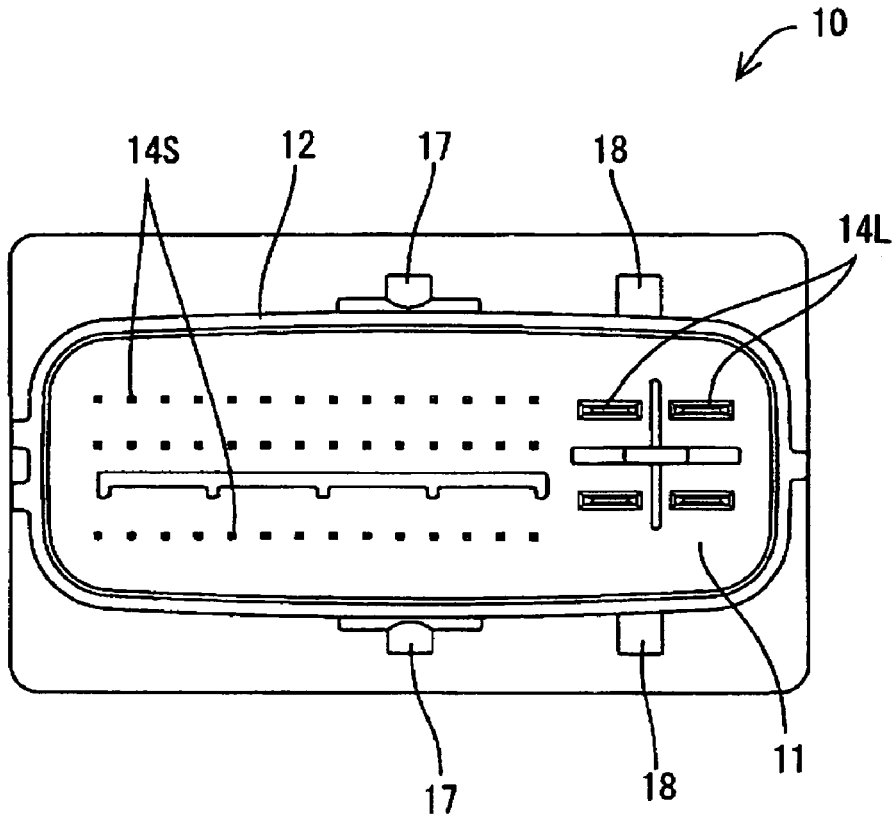
FIG. 4 is a front view of the male housing.

The male housing 10 is made e.g. of a synthetic resin and is formed such that a small receptacle 12 projects from the front surface of a main body 11 in the form of a laterally long block, as shown in FIG. 4. Four larger male terminals 14L project in a 2×2 array in a right end area of the back surface of the small receptacle 12 of the male housing 10 when viewed from the front, and smaller male terminals 14S project in three rows in a remaining area.

Figure 3:
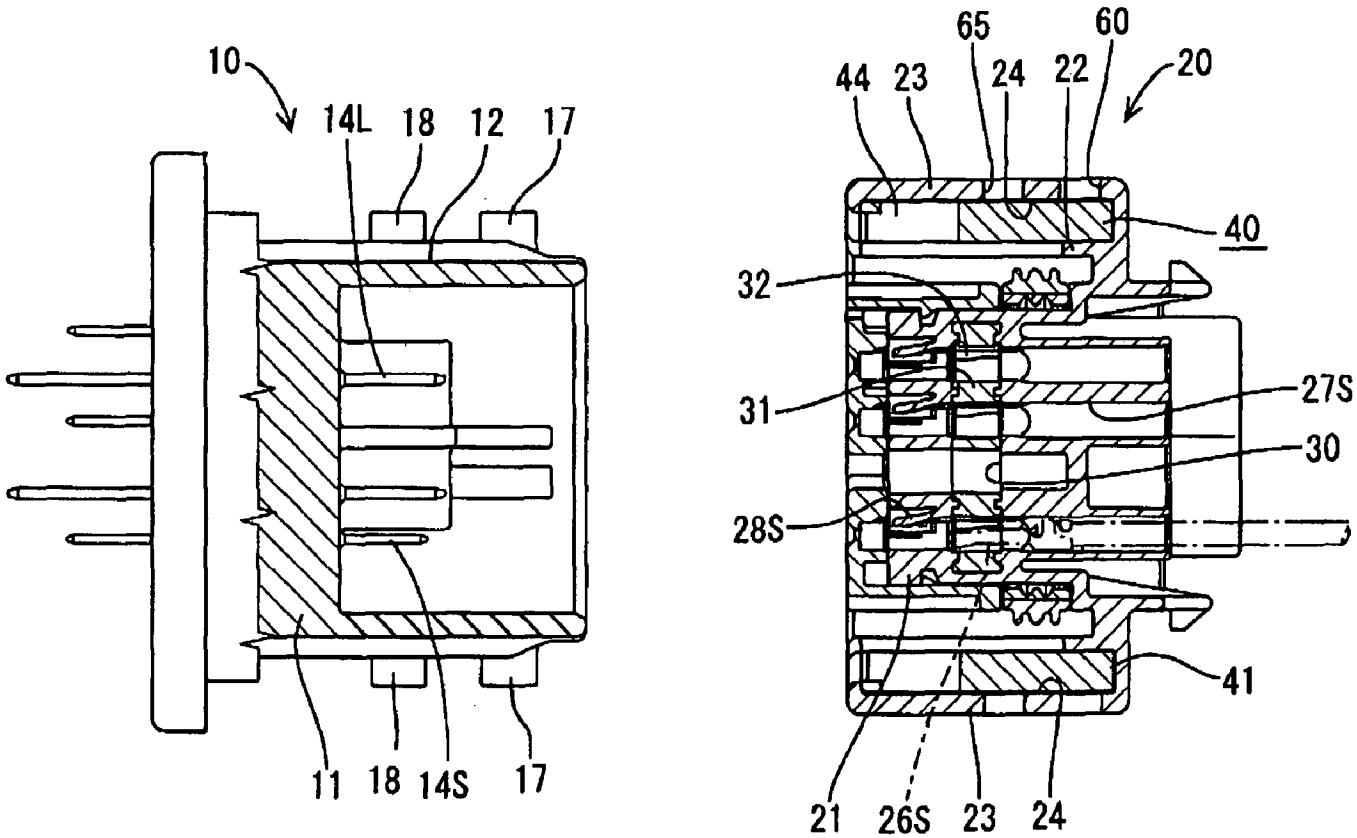
FIG. 3 is a longitudinal section of the male and female housings before being connected.

The female housing 20 is made e.g. of a synthetic resin and has a substantially flat tower 21 and a large receptacle 22 that surrounds the tower 21. The tower 21 can fit in the small receptacle 12 and the large receptacle 22 can fit on the outer surface of the small receptacle 12. Covers 23 are formed above and below the upper and bottom surfaces of the large receptacle 22 and are spaced apart by a specified distance, as shown in FIG. 3, and insertion paths 24 are defined between both covers 23 and the upper and bottom surfaces of the large receptacle 22. The insertion paths 24 are open at their left and right sides, and are substantially closed at front and rear sides.

Figure 5:
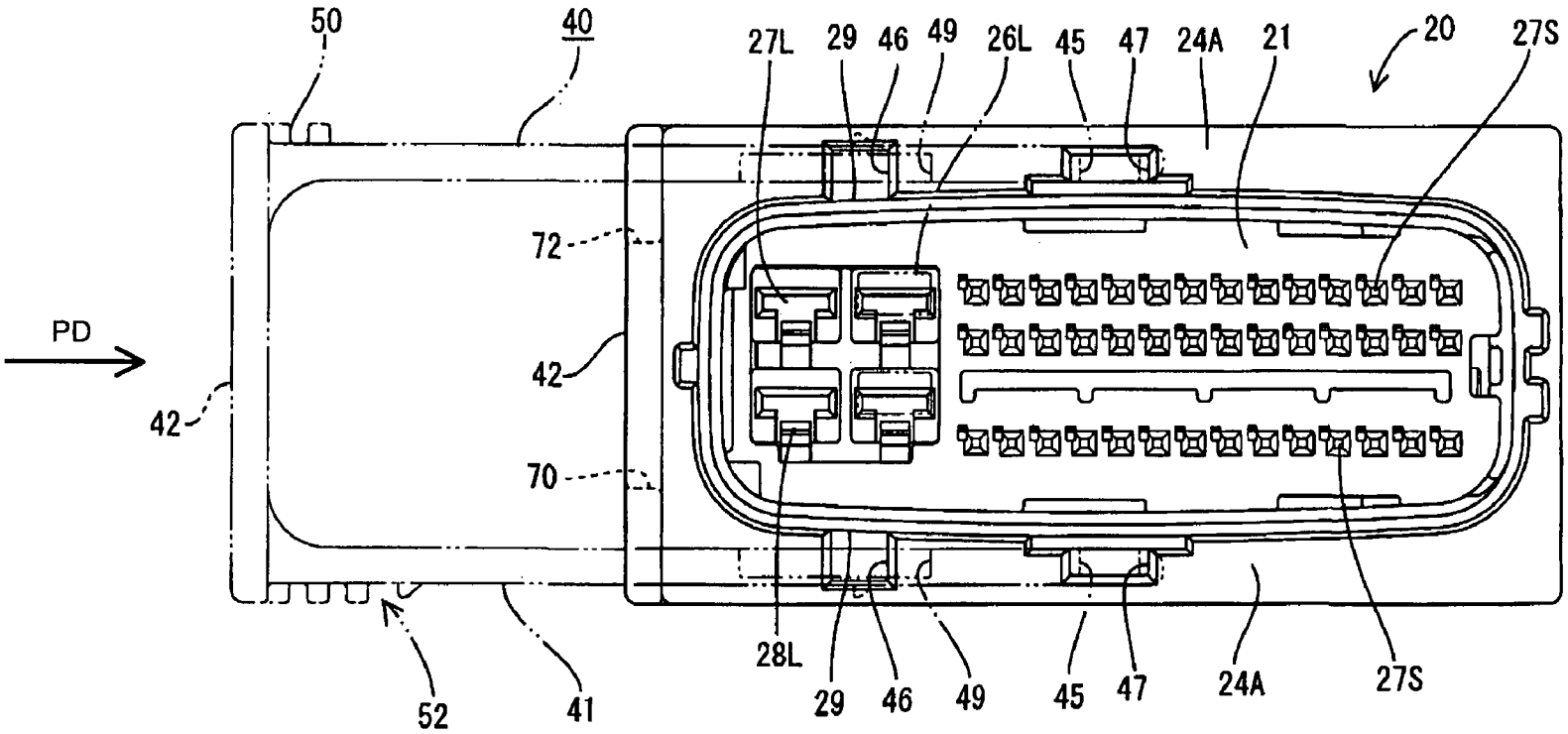
FIG. 5 is a front view of the female housing.

Four large cavities 27L are formed inside the tower 21, at a left area of the female housing 20 when viewed from the front (see FIG. 5). The large cavities 27L are configured for receiving the large female terminals 26L (see chain line in FIG. 5). The large cavities 27L are formed in a 2×2 array to correspond to the large male terminals 14L. Small cavities 27S are formed in a remaining area of the tower 21 and are configured to receive the small female terminals 26S (see chain line in FIG. 3). The small cavities 27S are disposed in e.g. three rows to correspond to the small male terminals 14S.

A large resiliently deformable lock 28L is provided in the bottom surface of each large cavity 27L for partly locking the large female terminal 26L. Similarly, a small resiliently deformable lock 28S is provided in the ceiling of each small cavity 27S for partly locking the small female terminal 26S.

A retainer insertion hole 30 opens in the left and right surfaces of the tower 21, and a retainer 31 is insertable into the retainer insertion hole 30 for doubly locking the large and small female terminals 26L, 26S (see FIG. 3).

The retainer 30 can be held at a partial locking position where locking projections 32 (only those for the smaller female terminals 26S are shown in FIG. 3) are located before the corresponding cavities 27L, 27S. The female terminals 26L, 26S then are inserted into the corresponding cavities 27L, 27S and are locked partly by the locks 28L, 28S. The retainer 31 then is pushed to a full locking position. Thus, the locking projections 32 of the retainer 30 enter the cavities 27L, 27S and engage the female terminals 26L, 26S that have been inserted into the cavities 27L, 27S. Accordingly, the female terminals 26L, 26S are locked redundantly by the retainer 31 and will not come out.

Figure 10:
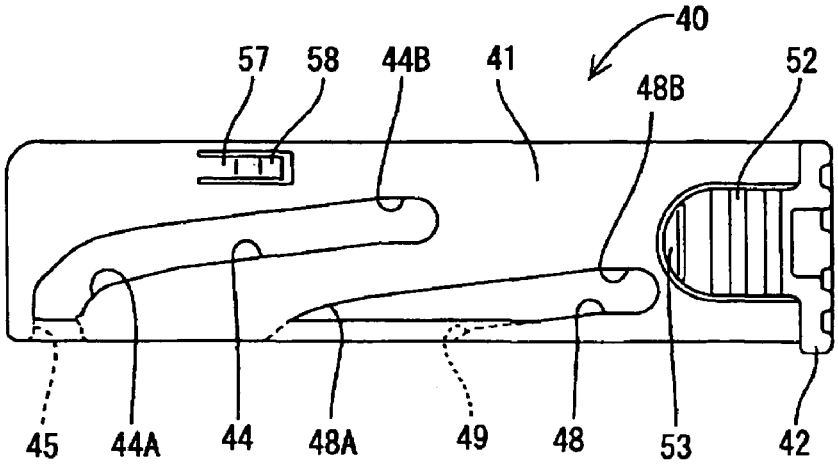
FIG. 10 is a bottom view of a slider.
Figure 11:
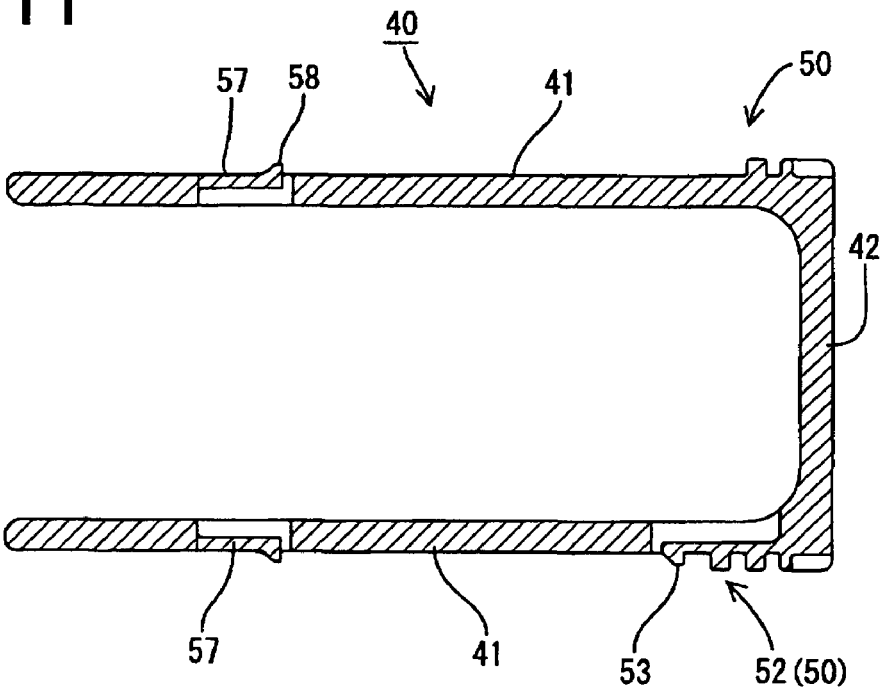
FIG. 11 is a longitudinal section of the slider.
Figure 12:
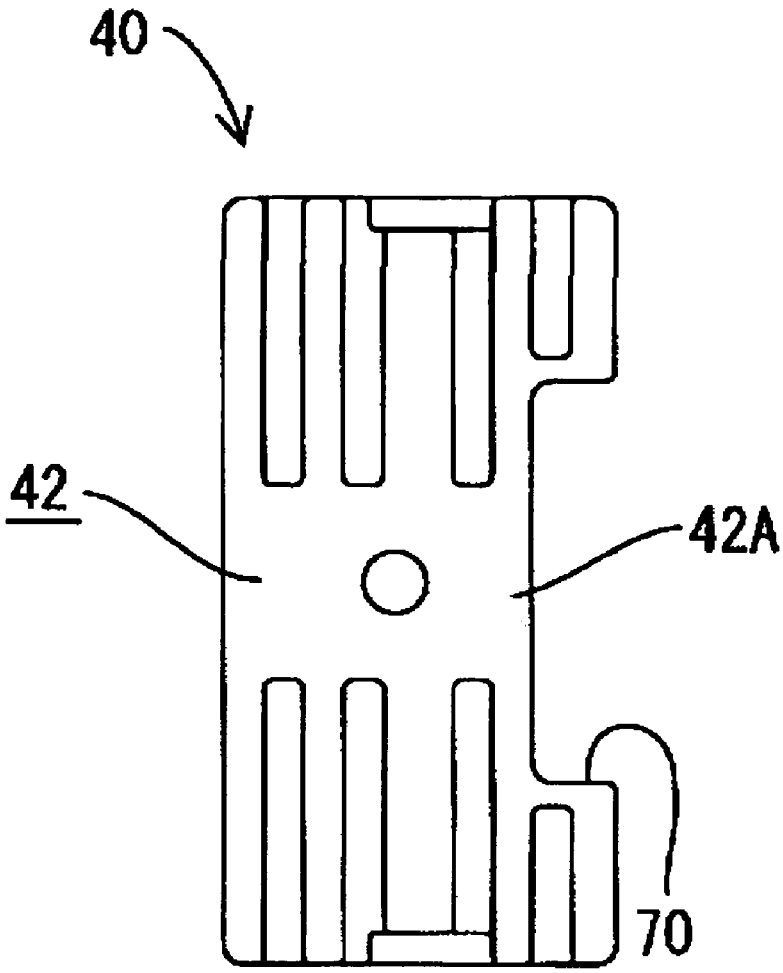
FIG. 12 is a side view of the slider.

The slider 40 is made e.g. of a synthetic resin similar to the female housing 20, but this synthetic resin material preferably has a color different from the color of the female housing 20. As shown in FIGS. 10 to 12, the slider 40 has a substantially gate or U-shape with two slidable plates 41 coupled by a coupling plate 42. The slider 40 is mounted by inserting the slidable plates 41 laterally into the upper and lower insertion paths 24 of the female housing 20.

Each slidable plate 41 has a main cam groove 44 that extends from the leading end of the front edge of the slidable plate 41 substantially to a longitudinal center while being gradually inclined toward the rear edge. The inclination of the main cam groove 44 is slightly steeper at a starting end 44A, and an entrance 45 of the main cam groove 44 is open at a substantially right angle to the front edge of the slidable plate 41. The entrance 45 is substantially continuous with the starting end 44A.

An auxiliary cam groove 48 is formed in a longitudinal middle portion of each slidable plate 41 and behind the main cam groove 44 with respect to a pushing direction PD of the slider 40. The auxiliary cam groove 48 extends substantially parallel with the main cam groove 44. An entrance 49 of the auxiliary cam groove 48 makes a wider opening at the front edge of the slidable plate 41 as compared to the main cam groove 44, and a starting end 48A of the auxiliary cam groove 48 near the entrance 49 is more moderately inclined than the starting end 44A of the main cam groove 44. The auxiliary cam groove 48 is arranged such that the starting end 48A thereof overlaps the main cam groove 44 along a pushing direction PD of the slider 40.

Main follower pins 17 project from widthwise middle positions near the front edges of the upper and lower surfaces of the small receptacle 12 as shown in FIGS. 1 to 4 and are engageable with the corresponding main cam grooves 44.

An auxiliary follower pin 18 projects at a position obliquely back from each main follower pin 17 and is received into the corresponding auxiliary cam groove 48. The auxiliary follower pins 18 are more distant from an engaging surface of the male housing 10 than the main follower pins 17. Thus, the auxiliary follower pins 18 reach the entrances 48A of the auxiliary cam grooves 48 at a more progressed stage of the connection of the housings 10, 20.

An introducing hole 47 is formed substantially at a widthwise middle of a front plate 24A of each of the upper and lower insertion paths 24 of the female housing 20 for permitting entry of the corresponding main follower pin 17. Similarly, an introducing hole 46 is formed at one side of each introducing hole 47, as shown in FIG. 5, for permitting entry of the corresponding auxiliary follower pin 18. Further, escape grooves (not shown) are formed substantially at a widthwise middle of the large receptacle 22 and are substantially continuous with the corresponding introducing hole 47. Similarly, escape grooves 29 are formed at one side of the former escape groove substantially continuous with the corresponding introducing hole 46. The escape grooves receive the main and auxiliary follower pins 17 and 18.

A grip 50 is formed on the outer surface of the base end of each slidable plate 41 of the slider 40 and is used to manipulate, insert and withdraw the slider 40. As shown in FIGS. 10 and 11, a resiliently deformable locking piece 52 is formed at one grip 50 and a locking claw 53 is formed at the leading end thereof.

Figure 6:
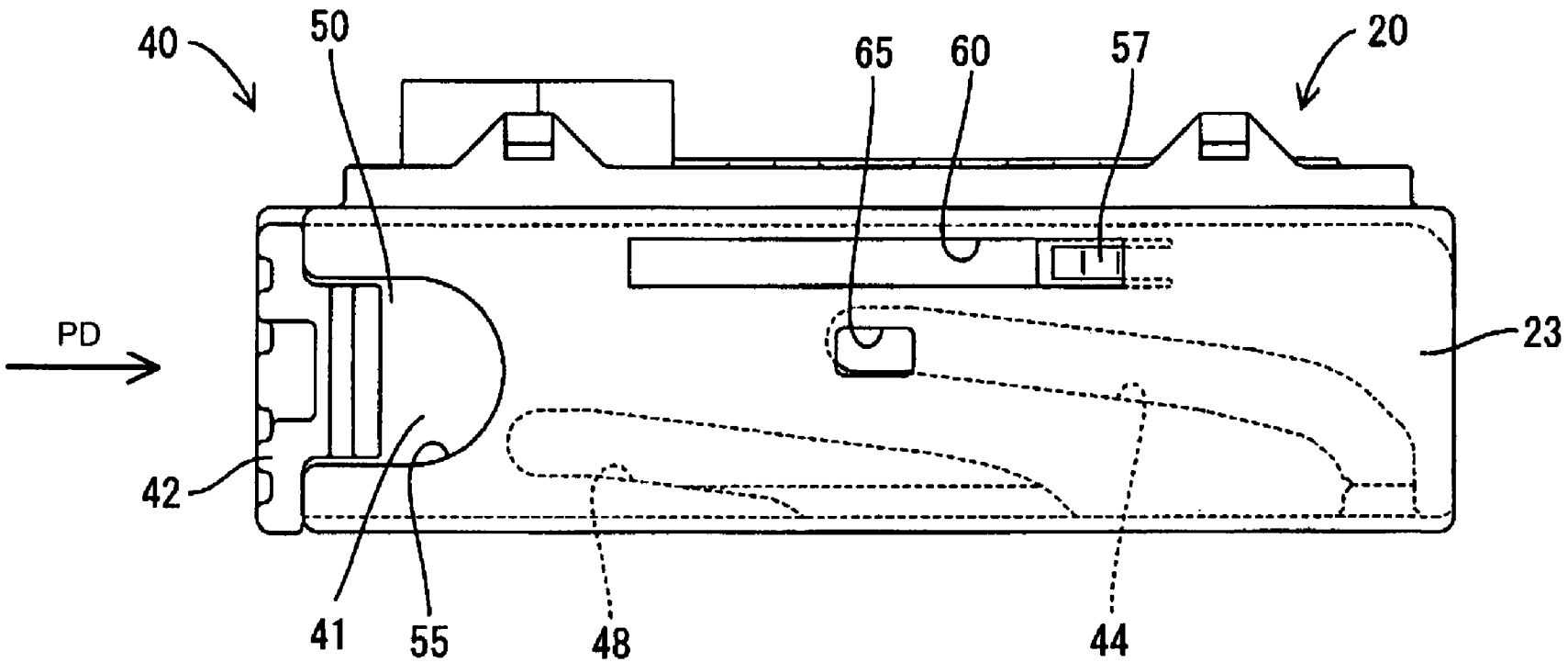
FIG. 6 is a plan view of the female housing.
Figure 7:
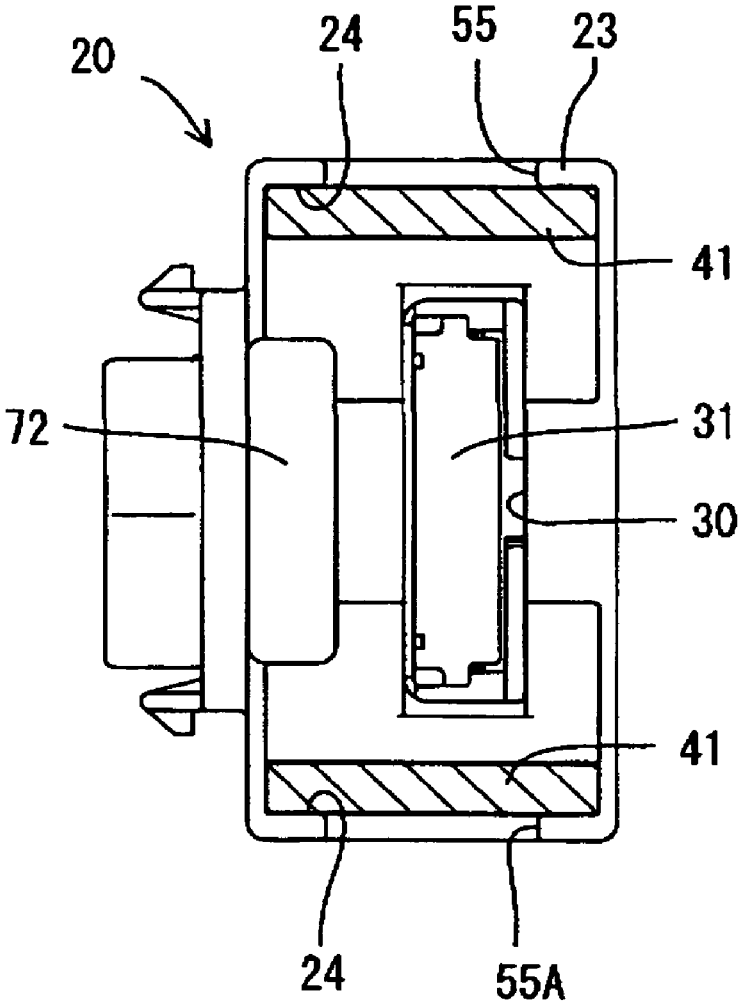
FIG. 7 is a side view of the female housing.
Figure 9:
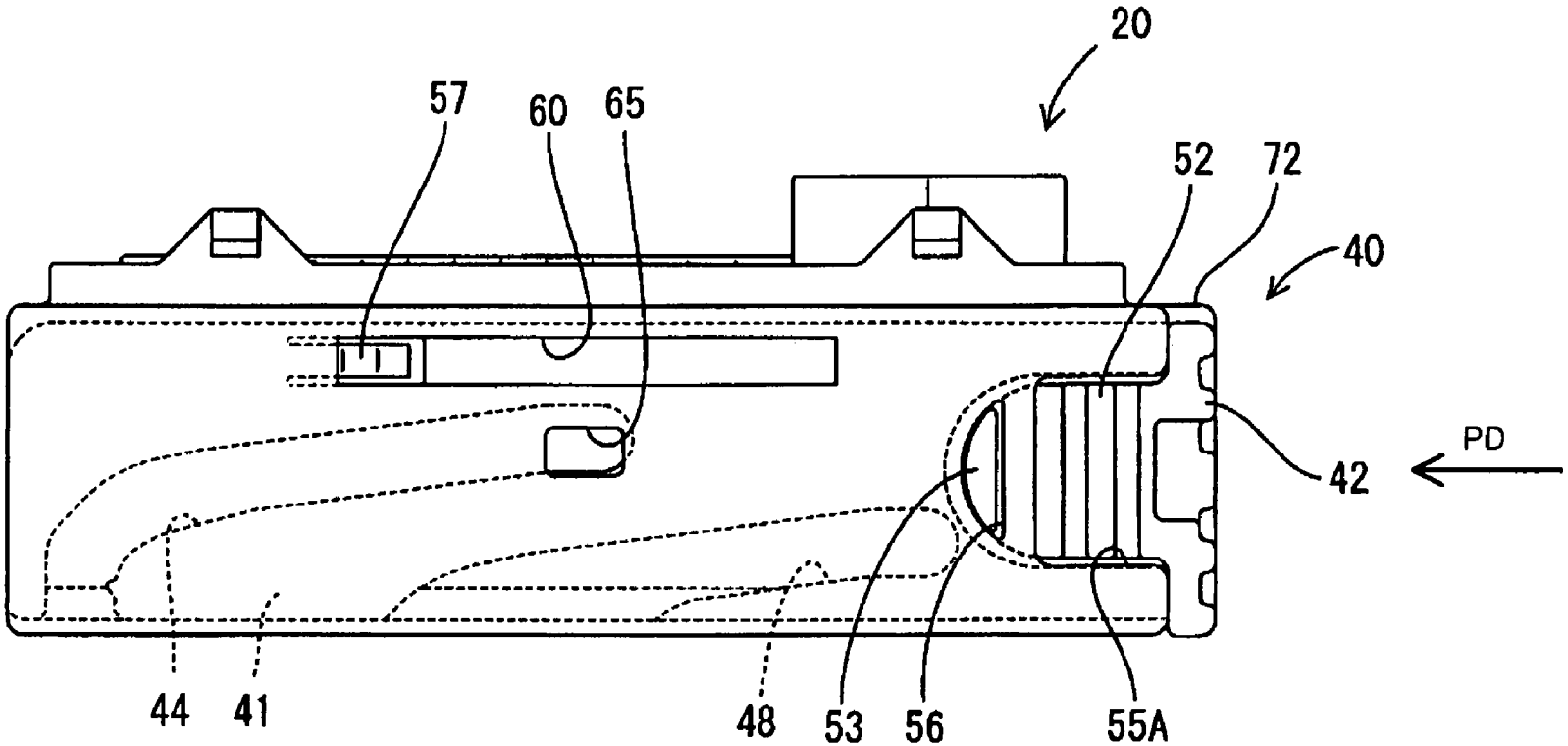
FIG. 9 is a bottom view of the female housing.

An escape groove 55 is formed at the left end of the upper cover 23 of the female housing 20 when viewed from the front as shown in FIG. 6, and is configured for receiving the grip 50 of the slider 40. Similarly, an escape groove 55A is formed at the left end of the lower cover 23 as shown in FIG. 9 for receiving the locking piece 52. A locking hole 56 is formed at the leading end of the escape groove 55A for receiving the locking claw 53 of the locking piece 52.

A first partial locking piece 57 is formed towards the rear edge of each slidable plate 41 of the slider 40 at a position corresponding to a substantially longitudinal middle of the main cam groove 44, as shown in FIGS. 10 and 11. The partial locking pieces 57 cantilever toward the base ends of the slidable plates 41 and are resiliently deformable. Protrusions 58 are formed on the outer surfaces of the projecting ends of partial locking pieces 57.

Figure 2:
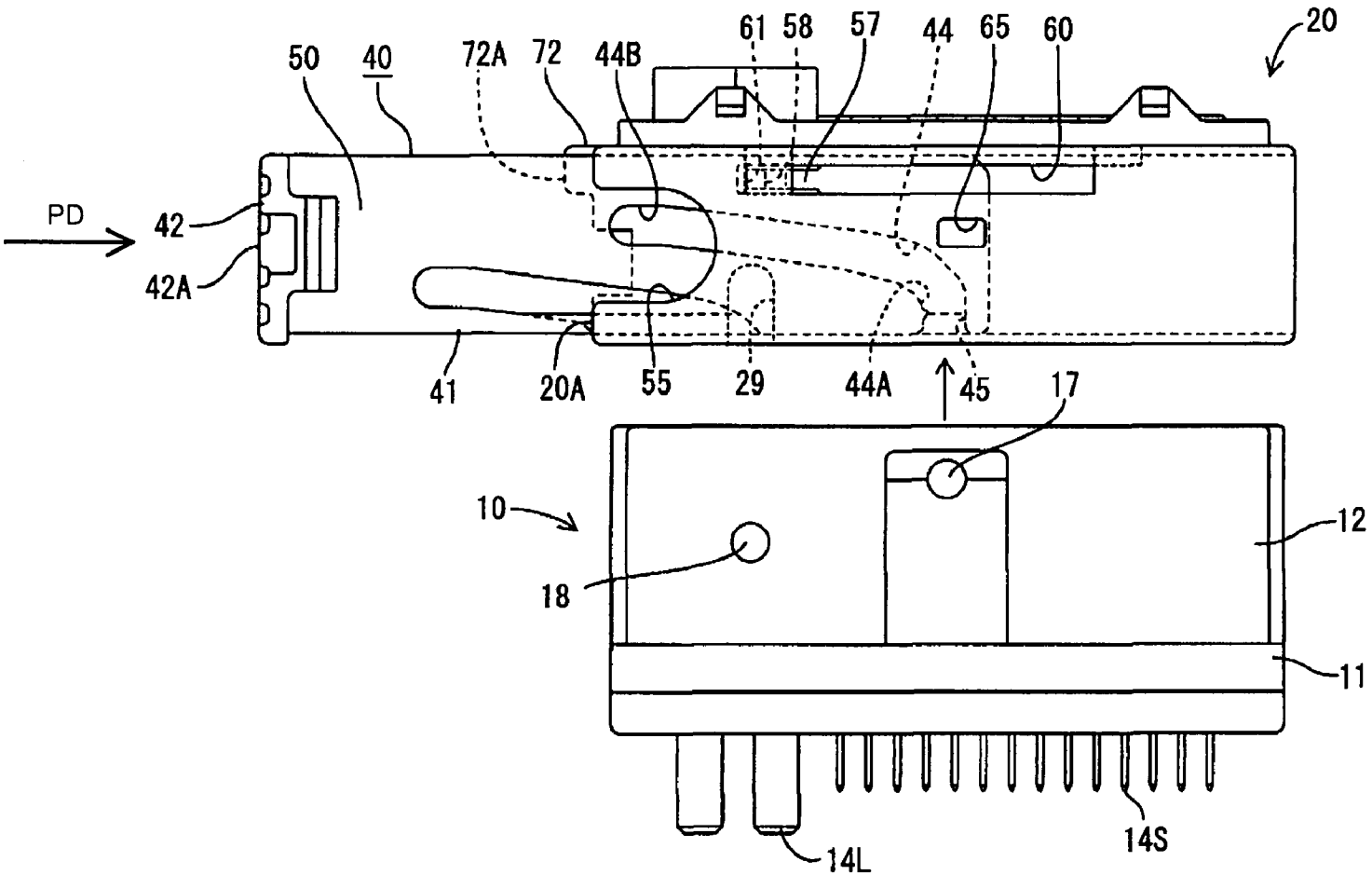
FIG. 2 is a plan view of the male and female housings before being connected.
Figure 8:
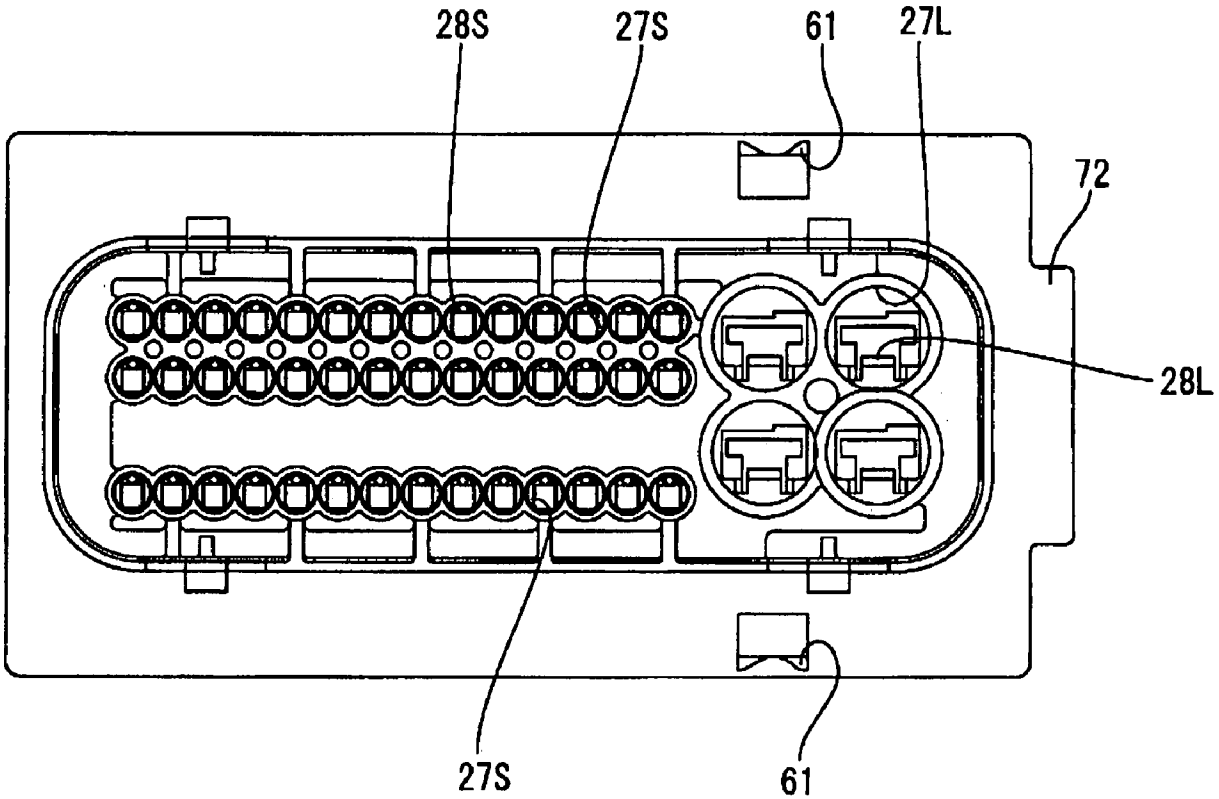
FIG. 8 is a rear view of the female housing.

A long groove 60 is formed in a substantially longitudinal middle of each cover 23 of the female housing 20 along a rear edge portion thereof, as shown in FIG. 2. The protrusions 58 of the partial locking pieces 57 fit into the long grooves 60. The opposite ends of each long groove 60 are closed at the outer surface, and locking holes 61 are formed in the inner surfaces of the closed portions for receiving the protrusion 58 of the corresponding partial locking piece 57, as shown in FIG. 8.

The slidable plates 41 of the slider 40 are inserted into the insertion paths 24 of the female housing 20 from the left side of FIG. 2. The protrusions 58 of the partial locking pieces 57 then drop into the locking holes 61 at the left ends of the long grooves 60 in FIG. 2 to hold the slider 40 at a retracted position. At this retracted position, the entrances 45 of the main cam grooves 44 align with the introducing holes 47 of the female housing 20 as shown in FIG. 2.

The slider 40 is pushed in the pushing direction PD to an advanced position where the coupling plate 42 contacts the left surface 20A of the female housing 20. At this advanced position, the locking claw 53 of the locking piece 52 fits into the locking hole 56 of the cover 23, as shown in FIG. 9, to lock the slider 40.

Each of the upper and lower covers 23 of the female housing 20 is formed with a confirmation window 65 for visually and/or automatically confirming whether the slider 40 is at the retracted position. Specifically, each confirmation window 65 has a substantially rectangular shape and is at a position slightly before the long groove 60 and in the longitudinal center of the cover 23 as shown in FIG. 2.

The back-side edge of the starting end 44A of the main cam groove 44 of each slidable plate 41 is in the entire corresponding confirmation window 65 only when the slider 40 is at the retracted position. Part of each main cam groove 44 is in the confirmation window 65 when the slider 40 is before the retracted position.

Figure 1:
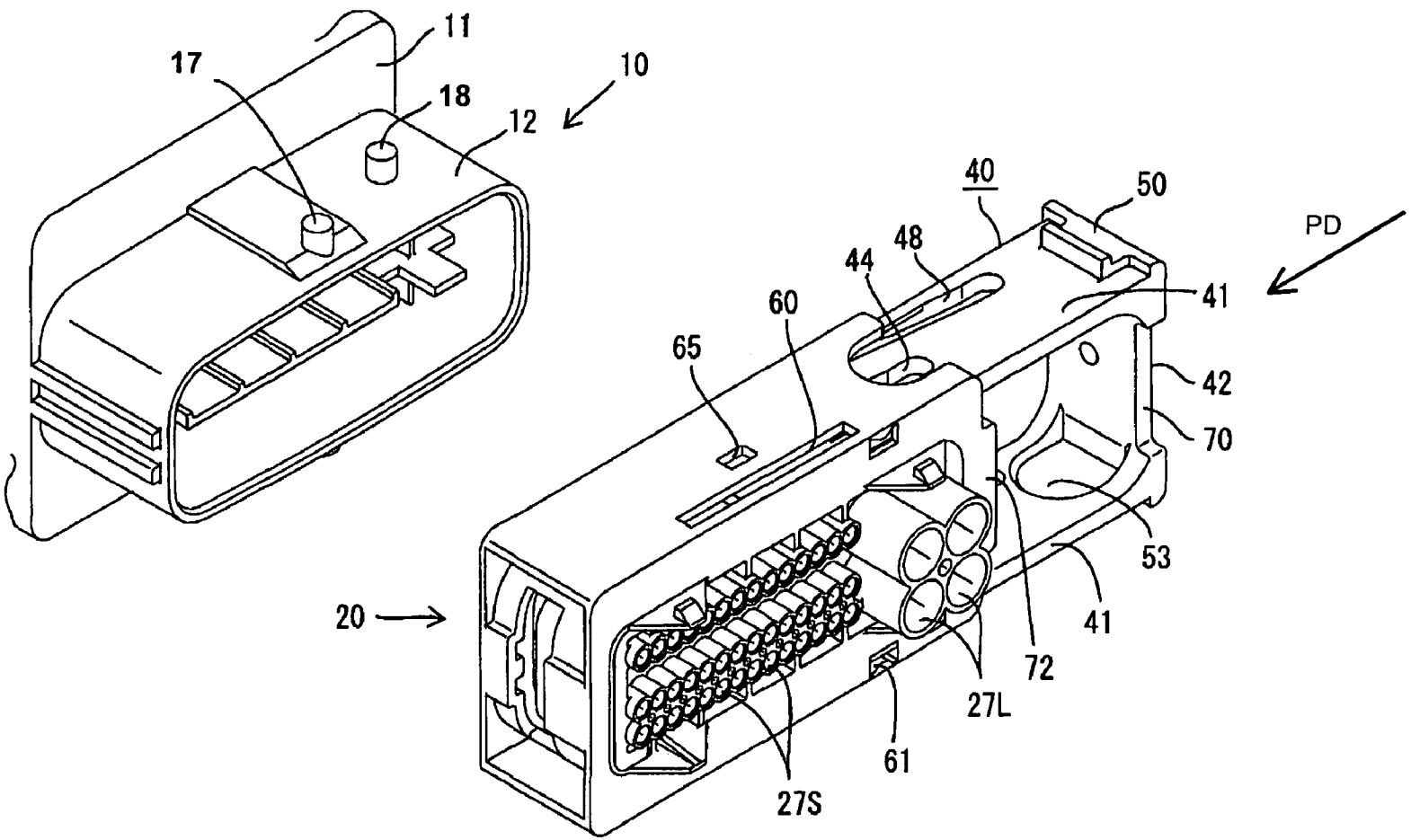
FIG. 1 is a perspective view of male and female housings according to a first embodiment of the invention before being connected.

The coupling plate 42 of the slider 40 also has a vertically long recess 70 at the back side substantially at a middle position with respect to height direction as shown in FIG. 1. The recess 70 provides an alternate means for detecting whether or not the slider 40 has reached the advanced position by hand feeling.

Figure 15:
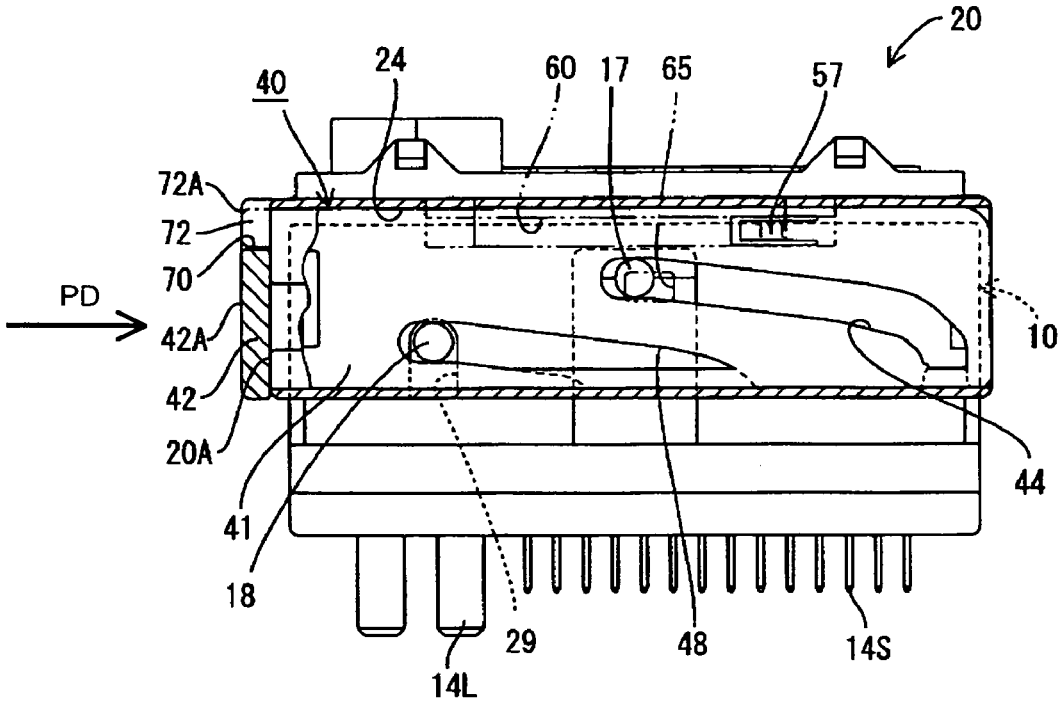
FIG. 15 is a plan view partly in section showing a completed state of the connection of the male and female housings.

A projection 72 is formed substantially at a middle position with respect to the height direction at the back side of the left surface 20A of the female housing 20, as shown in FIG. 8. The projection 72 is dimensioned to fit into the recess 70 of the slider 40. A projecting height of the projection 72 substantially equals the thickness of the coupling plate 42. The coupling plate 42 contacts the left surface 20A of the female housing 20 when the slider 40 reaches the advanced position. Thus, the projection 72 fits into the recess 70 and a projecting surface 72A of the projection 72 is substantially flush with an outer surface 42A of the coupling plate 42, as shown in FIG. 15.

The female terminals 26L, 26S are inserted into the cavities 27L, 27S of the female housing 20 and are locked doubly the retainer 31.

The slider 40 also is mounted into the female housing 20 in advance. The slidable plates 41 of the slider 40 are inserted into the insertion paths 24 from the left side of the female housing 20 and the slider 40 is pushed in one stroke along the pushing direction PD and into the advanced position. As shown in FIG. 9, at least part of the locking claw 53 of the locking piece 52 fits resiliently into the locking hole 56 to hold the slider 40 at the advanced position.

The female housing 20 is transported to a site of a connecting operation with the male housing 10 with the slider 40 mounted at the advanced position. Prior to the connection of the two housings 10, 20, the slider 40 is returned towards or to the retracted position. More particularly, the upper and lower grips 50 of the slider 40 are held e.g. by fingers. The locking piece 52 then is deformed resiliently in to cause the locking claw 53 to come out of the locking hole 56, thereby canceling the locked state. Accordingly, the slider 40 can be pulled while the grips 50 are held. In the meantime, the partial locking pieces 57 are returned along the long grooves 60. The slider 40 stops being pulled when the protrusions 58 fall into the locking holes 61. Thus, the slider 40 is held at the retracted position shown in FIG. 2. The confirmation window 65 enables a check to be performed for determining whether the slider has been returned properly to the retracted position.

Figure 13:
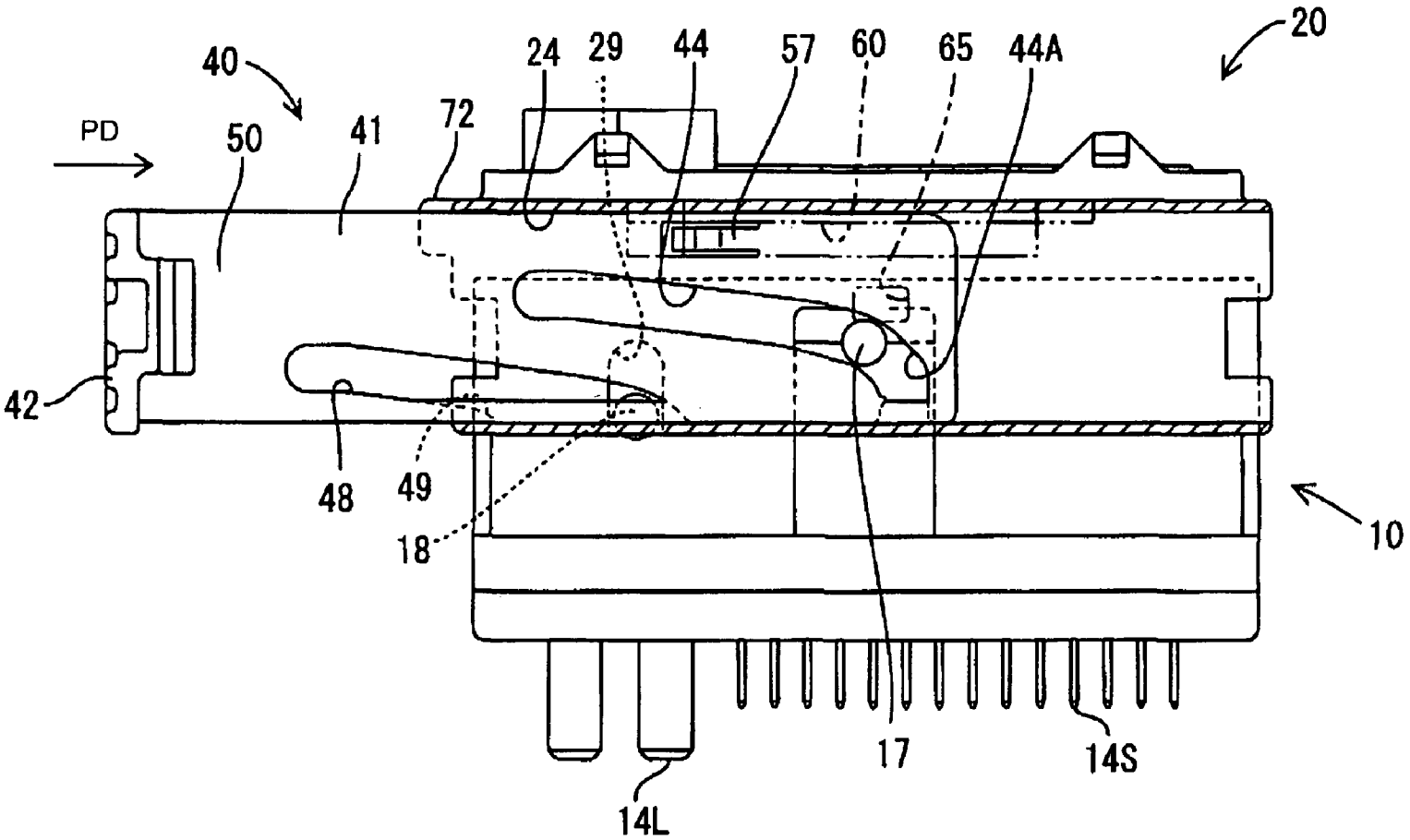
FIG. 13 is a plan view in section showing an initial stage of the connection of the male and female housings.

The male housing 10 can be fit at least partly into the large receptacle 22 of the female housing 20, as indicated by an arrow in FIG. 2, after the slider 40 has been returned to the proper retracted position. The main follower pins 17 of the male housing 10 then enter the entrances 45 of the main cam grooves 44 through the introducing holes 47. The male housing 10 is pushed further so that the main follower pins 17 push the back edges (upper edges in FIG. 13) of the starting ends 44A of the cam grooves 44, as shown in FIG. 13. As a result, the slider 40 is moved by a specified distance along the inclination of the starting ends 44 towards the advanced position. As a result, the main follower pins 17 enter the main cam grooves 44 and are caught by the front edges of the starting ends 44A to prevent disengagement of the male housing 10.

The connection of the two housings 10, 20 proceeds sufficiently for the main follower pins 17 to be caught by the front edges of the starting ends 44A of the main cam grooves 44. At this time, the auxiliary follower pins 18 are located near the entrances 49 of the auxiliary cam grooves 48 (see FIG. 13).

Figure 14:
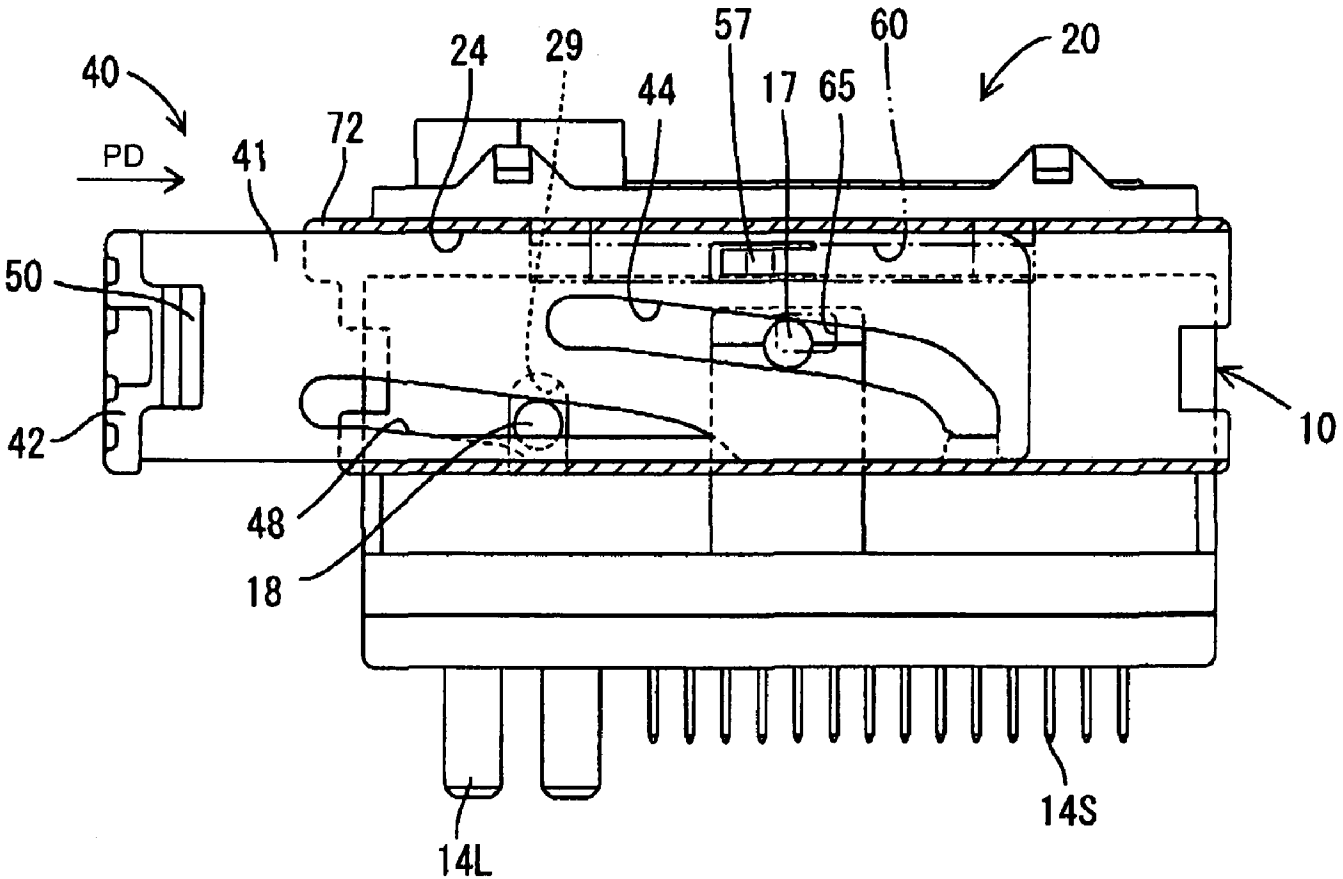
FIG. 14 is a plan view in section showing an intermediate stage of the connection of the male and female housings.

The slider 40 then is pushed in the pushing direction PD toward the advanced position as indicated by an arrow in FIG. 13. Thus, as shown in FIG. 14, the male housing 10 is pushed gradually into the female housing 20 mainly due to forces exerted on the front edges of the main cam grooves 44 on the follower pins 17. In the meantime, the auxiliary follower pins 18 move in the auxiliary cam grooves 48. The male and female housings 10, 20 are connected properly when the auxiliary follower pins 18 are moved to terminus ends 48B of the auxiliary cam grooves 48.

The locking claw 53 of the locking piece 52 fits into the locking hole 56, as shown FIG. 9, when the slider 40 is pushed sufficiently in the pushing direction PD to the advanced position. Simultaneously, the two housings 10, 20 are locked in their properly connected state. A part of the outer surface 42A of the coupling plate 40 near the recess 70 can be touched by hand to confirm whether the slider 40 has been pushed properly to the advanced position.

The locking achieved by the main follower pins 17 and the auxiliary follower pins 18 in the properly connected state prevents the two housings 10, 20 from shaking in a rotating direction or being displaced pivotally with respect to each other. The connection of the two housings 10, 20 is guided by the engagement of the main follower pins 17 and the main cam grooves 44, and the guide brought about by the engagement of the auxiliary follower pins 18 and the auxiliary cam grooves 48 is only secondary. Accordingly, the auxiliary cam grooves 48 can be shorter than the main cam grooves 44 and can be so arranged to overlap the main cam grooves 44 along the pushing direction PD. Thus, the length of the main cam grooves 44 can be longer and the inclination of the main cam grooves 44 can be more moderate as compared to a case where the auxiliary cam grooves 48 do not overlap the main cam grooves 44. Therefore, operation forces used to advance and retract the slider 40 are low.

A connector of a second embodiment shown in FIGS. 16 to 20 has substantially the same construction as that of the first embodiment, but the positions of auxiliary cam grooves and auxiliary follower pins differ from those of the first embodiment. Hereinafter, no repeated description is given for elements that have the same or similar construction as the first embodiment.

Figure 17:
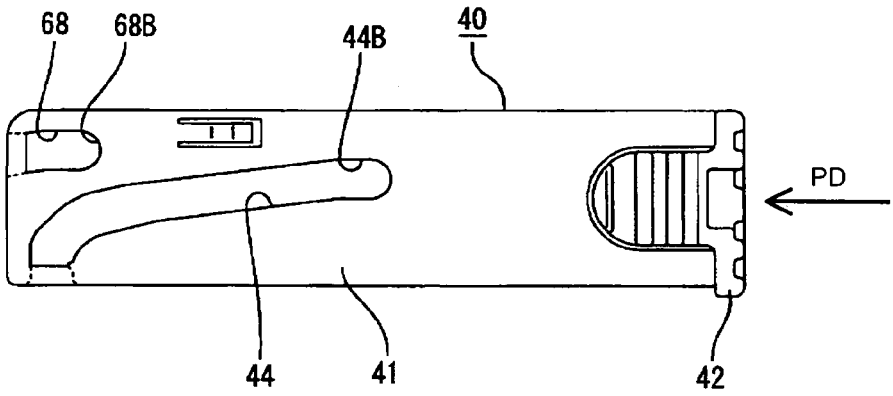
FIG. 17 is a bottom view of a slider.

A slider 40 has a gate or U-shape with two slidable plates 41 coupled by a coupling plate 42. Main cam grooves 44 similar to those of the first embodiment are formed in both slidable plates 41. As shown in FIG. 17, auxiliary cam grooves 68 are formed behind the main cam grooves 44 with respect to a connecting direction CD of the two housings 10, 20. Each auxiliary cam groove 68 has a starting end at an end of the slidable plate 41 opposite from the coupling plate 42, and extends slightly oblique to a retracting direction of the slider 40 between the starting end and a terminus end 68B.

Figure 16:
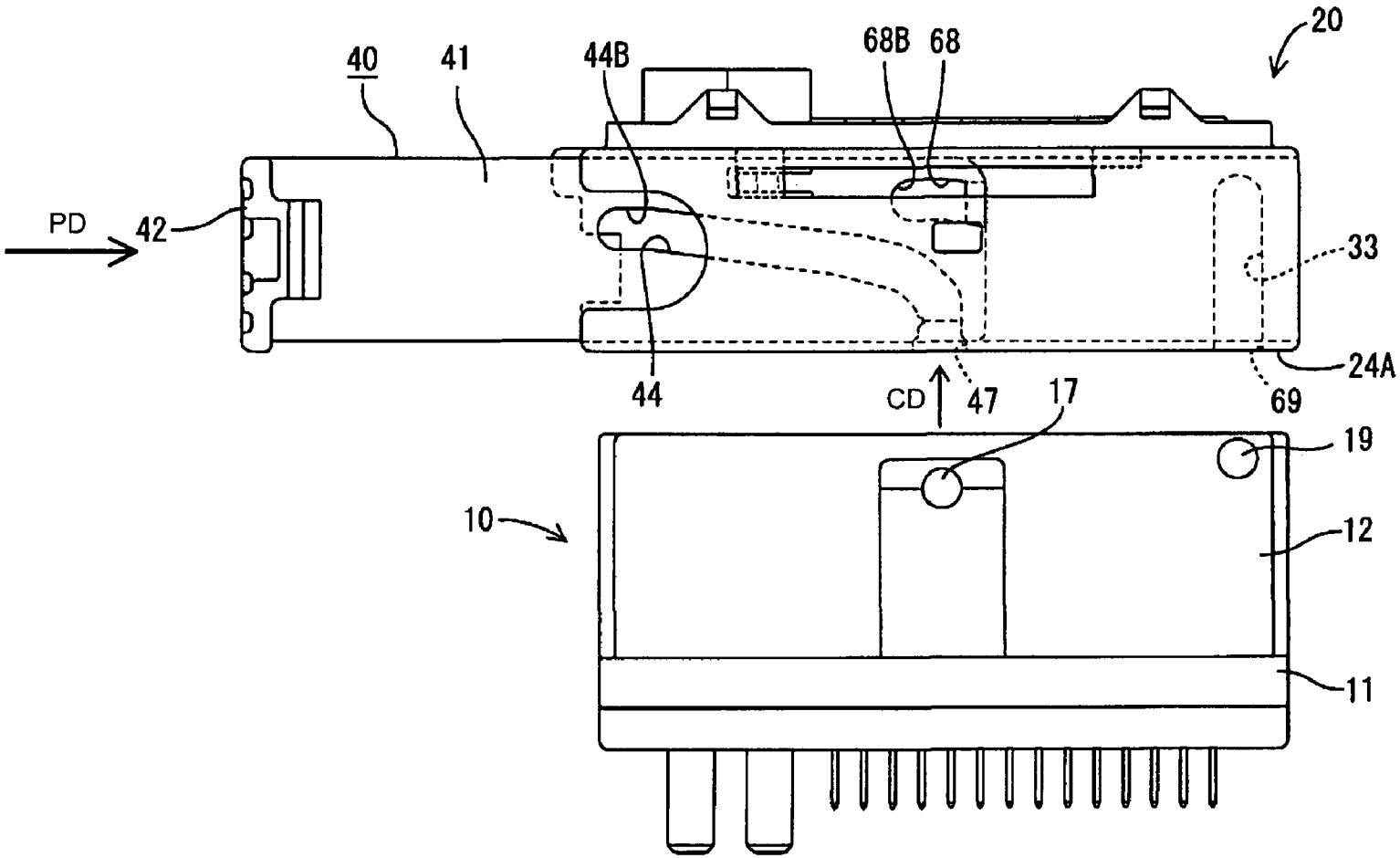
FIG. 16 is a plan view of male and female housings according to a second embodiment of the invention before being connected.

The male housing 10 has a small receptacle 12, and a main follower pin 17 stands substantially at a widthwise middle position near the front edge of each of the upper and lower surfaces of the small receptacle 12. The main follower pins 17 are engageable with the corresponding main cam grooves 44. An auxiliary follower pin 19 projects at a position obliquely forward from each main follower pin 17 as shown in FIG. 16 and is engageable with the corresponding auxiliary cam groove 68 at a final stage of the connection of the two housings 10, 20.

Introducing holes 47 and 49 are formed in a front plate 24A of each of the upper and lower insertion paths 24 of the female housing 20. The introducing holes 47 permit entry of the corresponding main follower pins 17 and the introducing holes 69 permit entry of the corresponding auxiliary follower pin 68. Further, escape grooves (not shown) are formed substantially at a widthwise middle of a larger receptacle 22 continuous with the corresponding introducing hole 47. Similarly, escape grooves 33 are substantially continuous with the corresponding introducing hole 69. These escape grooves permit the entrance of the main and auxiliary follower pins 17 and 19.

The male housing 10 is fit at least partly into the larger receptacle 22 of the female housing 20 with the slider 40 at the retracted position. Thus, the main follower pins 17 of the male housing 10 enter the entrances 45 of the main cam grooves 44 through the introducing holes 47 and the escape grooves. Similarly, the auxiliary follower pins 19 enter the escape grooves 33 through the introducing holes 69. The male housing 10 is pushed further, and thus the slider 40 moves a specified distance along the inclination of the main cam grooves 44 toward an advanced position.

Figure 18:
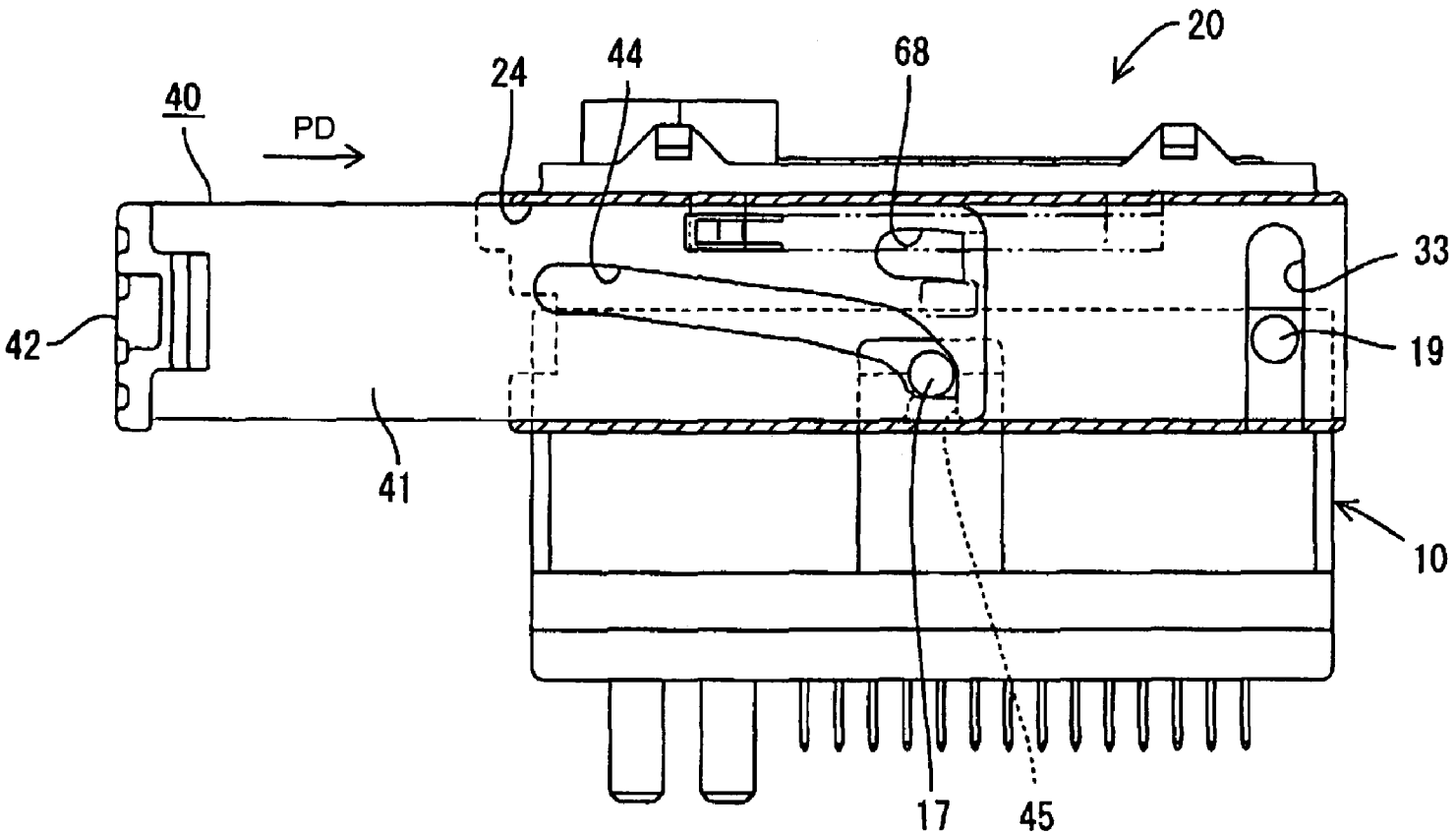
FIG. 18 is a plan view in section showing an initial stage of the connection of the male and female housings.
Figure 19:
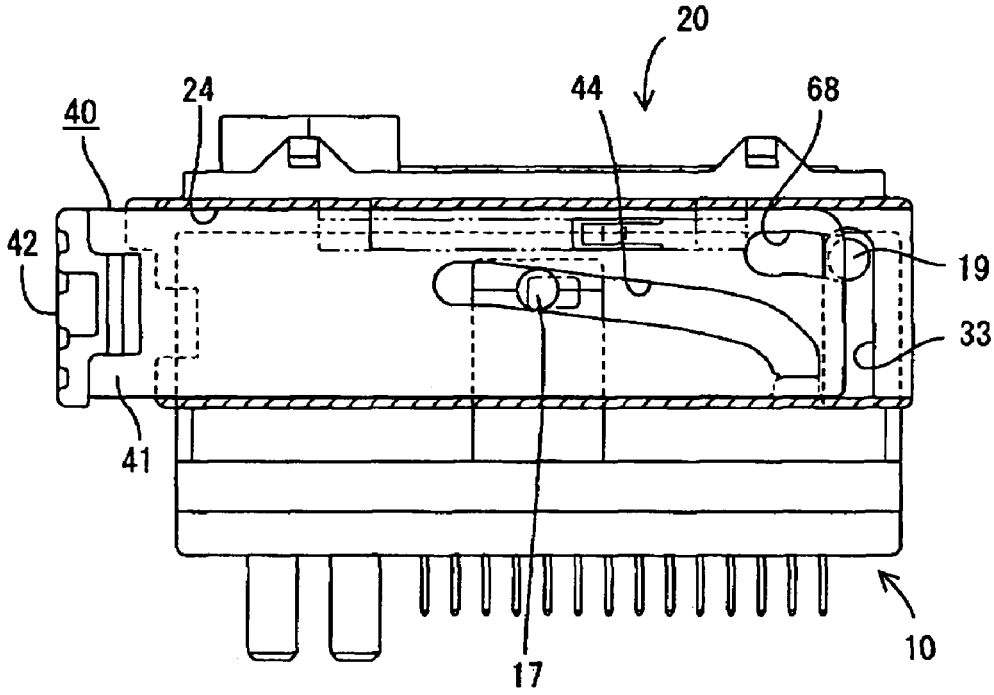
FIG. 19 is a plan view in section showing an intermediate stage of the connection of the male and female housings.

Subsequently, the slider 40 is pushed in the pushing direction PD toward the advanced position, as indicated by an arrow in FIG. 18. Accordingly, the male housing 10 is drawn gradually into the female housing 20 mainly by a cam action displayed by the front edges of the main cam grooves 44 pushing the follower pins 17, as shown in FIG. 19.

Figure 20:
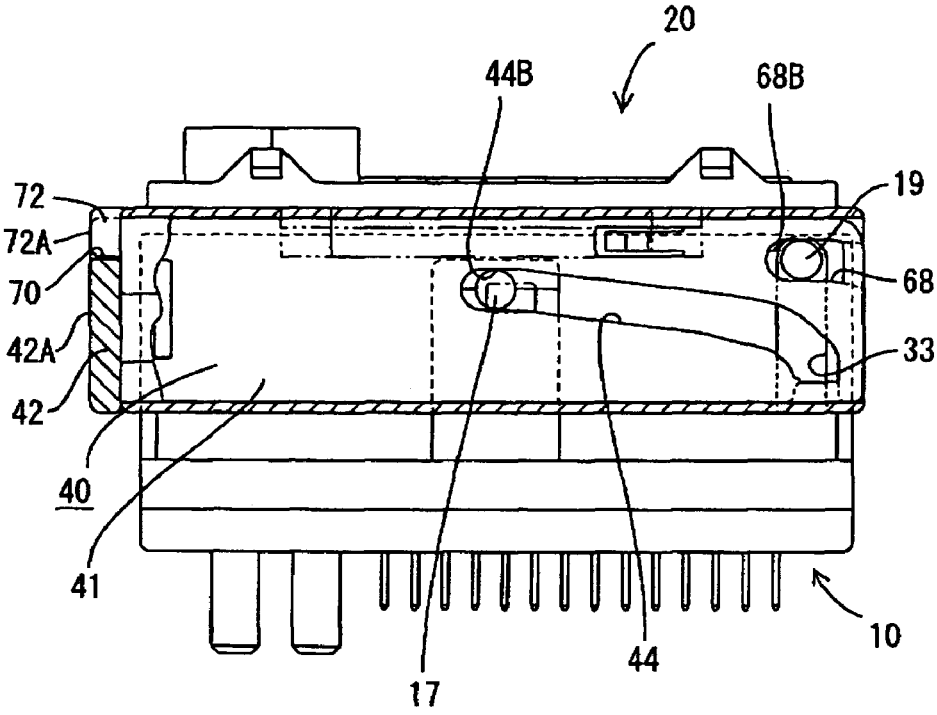
FIG. 20 is a plan view partly in section showing a completed state of the connection of the male and female housings.

The main follower pins 17 move towards the terminus ends of the main cam grooves 44 as the slider 40 is pushed in the pushing direction PD. The auxiliary follower pins 19 enter the auxiliary cam grooves 68 in the final stage of the connection of the two housings 10, 20 and after the main follower pins 17 move beyond the longitudinal middles of the main cam grooves 44 (see FIG. 19). The slider 40 continues to be pushed in the pushing direction PD to the advanced position. As a result, the main follower pins 17 are moved to terminus ends 44B of the main cam grooves 44 and the auxiliary follower pins 19 are moved to the terminus ends 68B of the auxiliary cam grooves 68, as shown in FIG. 20. Consequently, the male and female housings 10, 20 are connected properly connected.

Similar to the first embodiment, the two housings 10, 20 are prevented from shaking in a rotating direction because the main and auxiliary follower pins 17, 19 of the male housing 10 and the main and auxiliary cam grooves 44, 68 of both the slidable plates 41 are engaged at two locking positions in the properly connected state. Additionally, the auxiliary follower pins 19 engage the auxiliary cam grooves 68 immediately before the connection of the two housings 10, 20 is completed. Thus, the length of the auxiliary cam grooves 68 can be even shorter than in the first embodiment and the main cam grooves 44 can be accordingly made longer. Therefore, a force required for the connecting operation is less than in the first embodiment.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

In the foregoing embodiment, a holding mechanism is formed by the auxiliary cam grooves and the auxiliary follower pins. Instead of such a cam mechanism, the holding mechanism may be a lock arm to engage a mating partner when the connection is completed. In such a case, the lock arm may be engaged between the slider and the housing or between the two housings.

The auxiliary grooves are formed in the slider and the auxiliary follower pins are formed on the male housing in the foregoing embodiment. However, the arrangement of the auxiliary cam grooves and the auxiliary follower pins may be reversed.

The slider may be mounted into or to the male housing.

The invention has been described with reference to a slider that is linearly movable along the pushing direction. However, the cam action could be displayed by a different movable member, such as a rotatable or pivotable lever, a movable member movable substantially along a non-linear path, etc.

Figure 21:
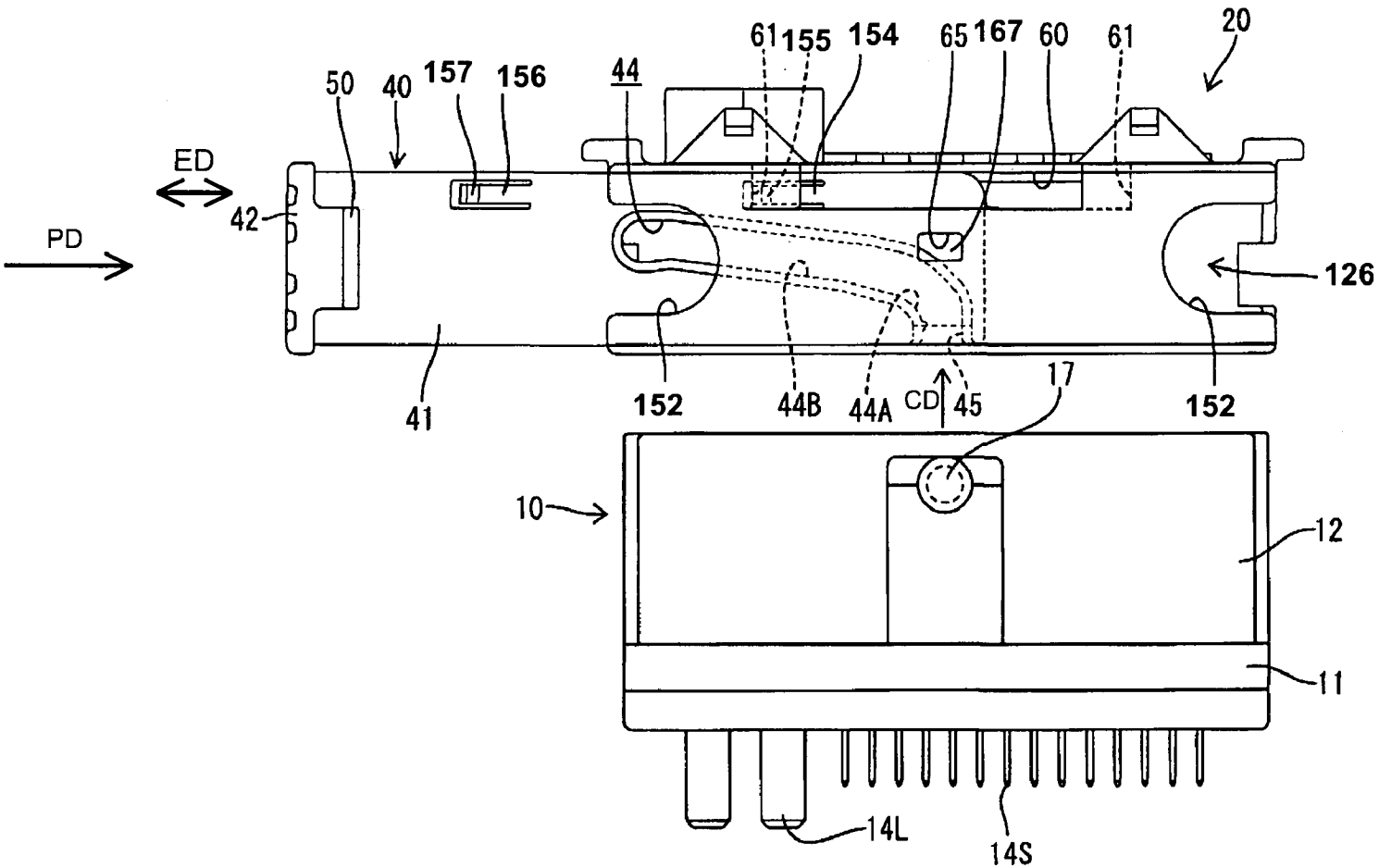
FIG. 21 is a plan view of male and female housings according to a third embodiment of the invention before being connected.
Figure 22:
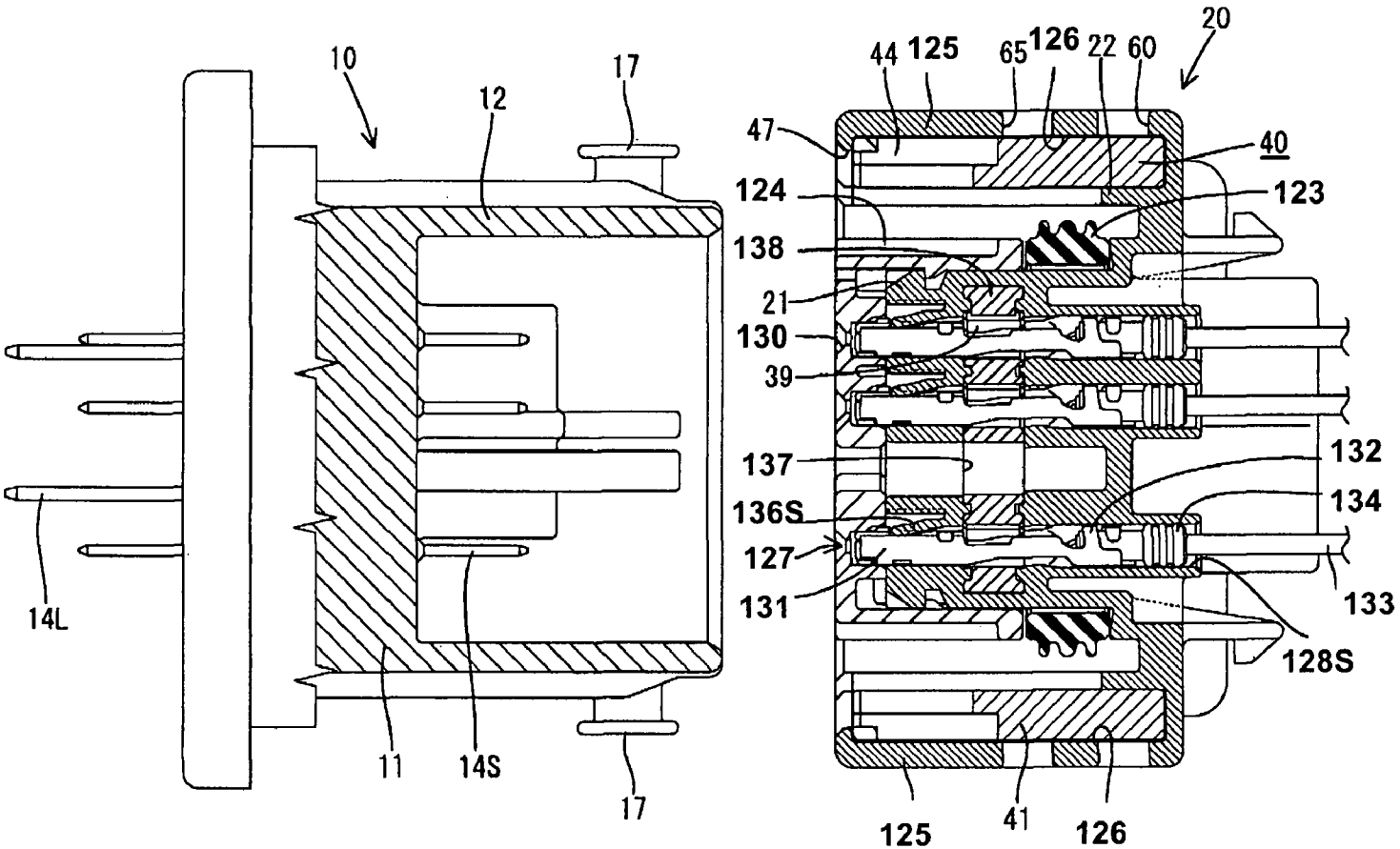
FIG. 22 is a longitudinal section of the male and female housings before being connected.

A third embodiment of the invention is illustrated in FIGS. 21 to 35. As shown in FIGS. 21 and 22, this connector has a male housing 10 and a female housing 20 that are connectable with each other. A slider 40 is mounted in the female housing 20.

Figure 23:
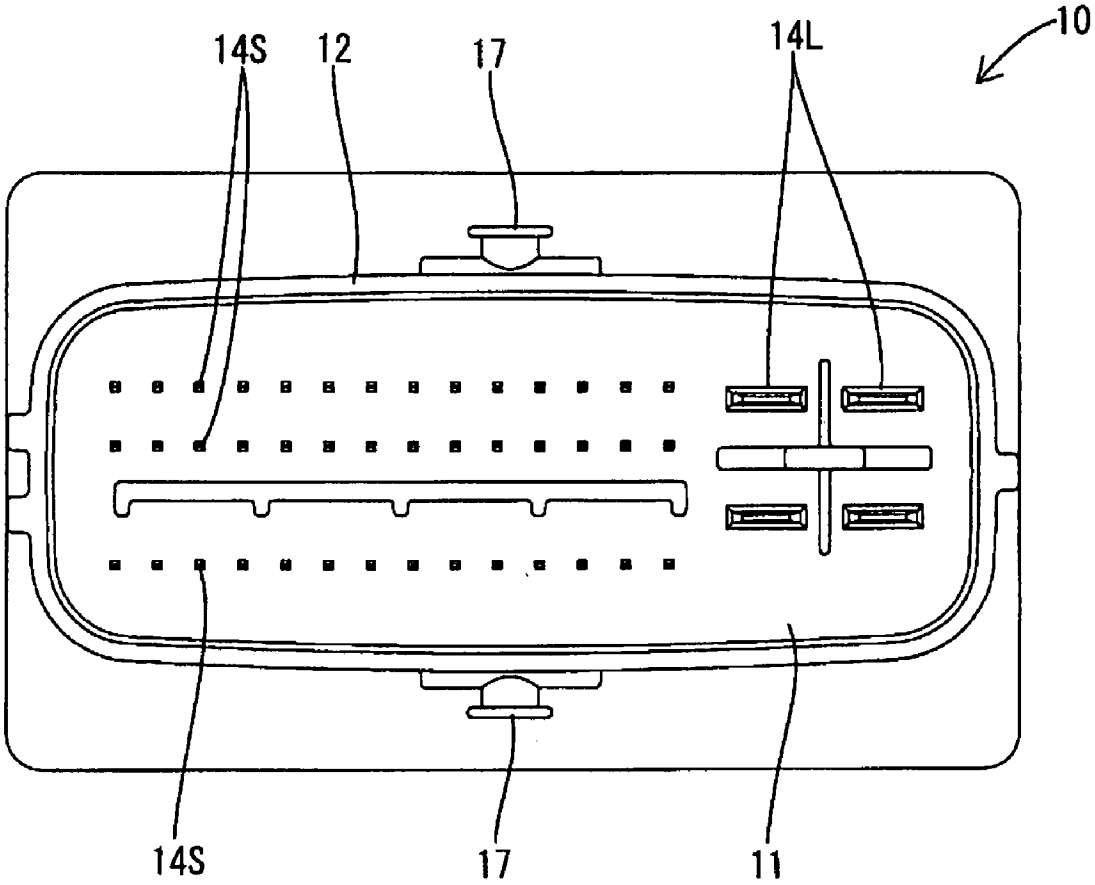
FIG. 23 is a front view of the male housing.

The male housing 10 is made e.g. of a synthetic resin and has a main body 11 and a small receptacle 12. The main body 11 is in the form of a wide block, and the small receptacle 12 projects from the front surface of the main body 11, as also shown in FIG. 23. Four large male terminals 14L project in a 2×2 array in a right end area of the back surface of the smaller receptacle 12 of the male housing 10 when viewed from the front, and small male terminals 14S project in three rows in a remaining area.

Figure 24:
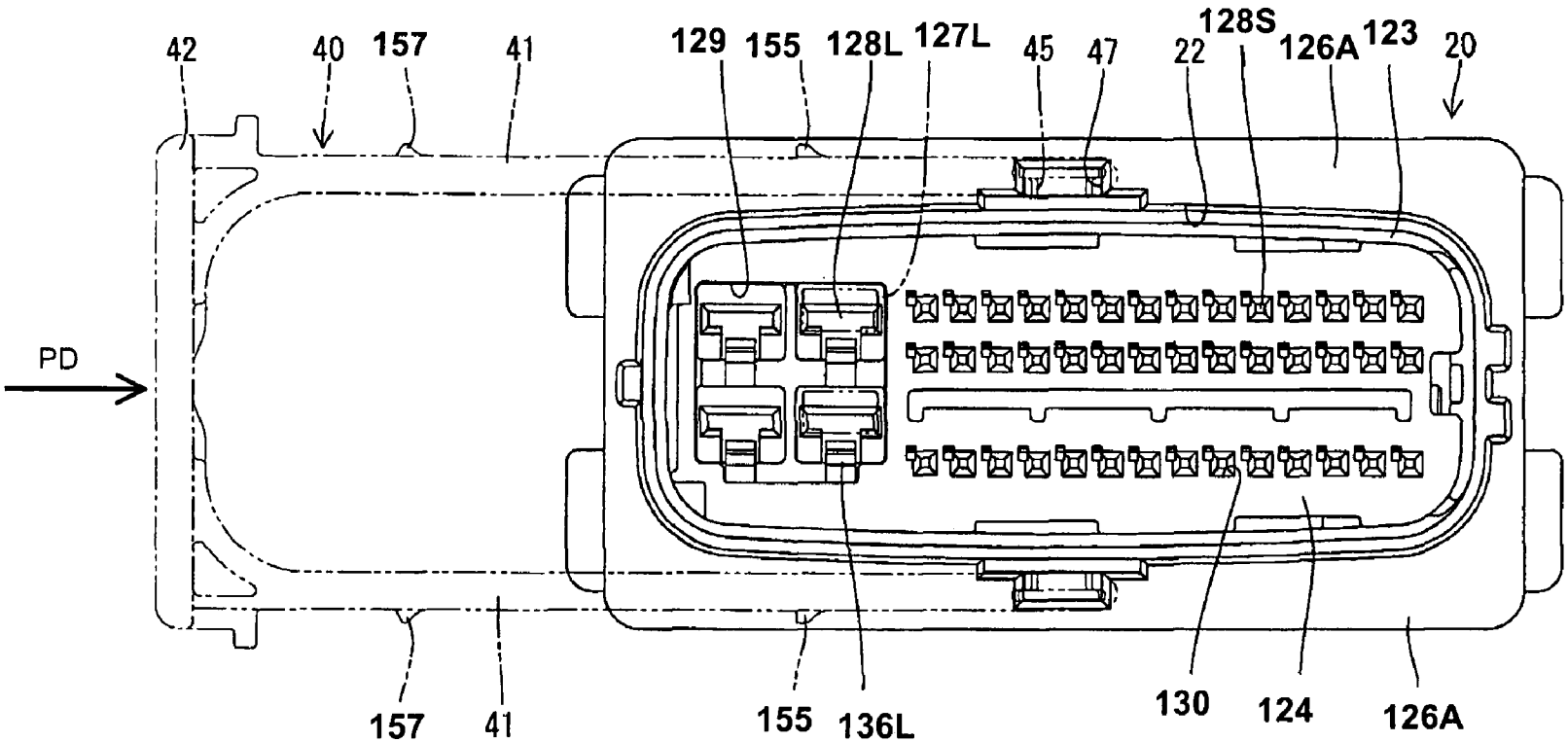
FIG. 24 is a front view of the female housing.

The female housing 20 also is made e.g. of a synthetic resin and has a tower 21 and a large receptacle 22 is formed around the tower 21. The large receptacle 22 can fit on the outer surface of the small receptacle 12 of the male housing 10 and the tower 21 can fit into the small receptacle 12, as shown in FIG. 24. A seal ring 123 is mounted at a back side of the outer peripheral surface of the tower 21 and can be brought resiliently into close contact with the inner peripheral surface of the small receptacle 12. Further, a bottomed tubular cap 124 is fit on a front part of the tower 21 to lock the seal ring 123 so as not to come out. Covers 125 are formed above and below the upper and bottom surfaces of the large receptacle 22 and are spaced apart by a specified distance. Insertion paths 126 are defined between both covers 125 and the upper and bottom surfaces of the large receptacle 22. The insertion paths 126 are open at their left and right sides while being closed at front and rear sides.

Four large cavities 128L are formed in a left area of the tower 21 when viewed from the front, as shown in FIG. 24, and define a 2×2 array that corresponds to the arrangement of the larger male terminals 14L Large female terminals 127L are accommodated in the large cavities 128L. The large female terminals 127L are not shown in detail, but are structurally similar to small female terminals 127S described below. Fourteen smaller cavities 128S are formed in each of three rows in a remaining area of the tower 21 and substantially correspond to the smaller male terminals 14S. Small female terminals 127S are accommodated in the small cavities 128S. The respective cavities 128L, 128S have open front and rear ends, and the smaller female terminals 127S can be stopped at their front-limit positions by the cap 124 that covers the front ends of the smaller cavities 128S. An engaging hole 129 and terminal insertion holes 130 are formed in the front surface of the cap 124. The engaging hole 129 engages the front ends of surrounding walls of the four larger cavities 28L and the terminal insertion holes 130 are at positions substantially corresponding to the respective smaller cavities 28S and permit the passage of respective smaller terminals 14S.

A tubular terminal connecting portion 131 is formed at a front part of each of the large and small female terminals 127L, 127S, and a resilient contact piece (not shown) is inside each tubular terminal connecting portion 131. The resilient contact piece resiliently contacts the male terminal 14L, 14S to establish electrical connection when a mating male terminal 14L, 14S is inserted into the terminal connecting portion 131 from the front. A barrel 132 is provided at a rear part of each female terminal 127L, 127S, and is crimped, bent or folded into connection with an end of a wire 133. A resilient or rubber plug 134 is mounted on the end of the wire 133. The outer circumferential surface of the rubber plug 134 can be brought resiliently into close contact with the inner circumferential surface of a rear part of the cavity 28L, 28S.

Figure 26:
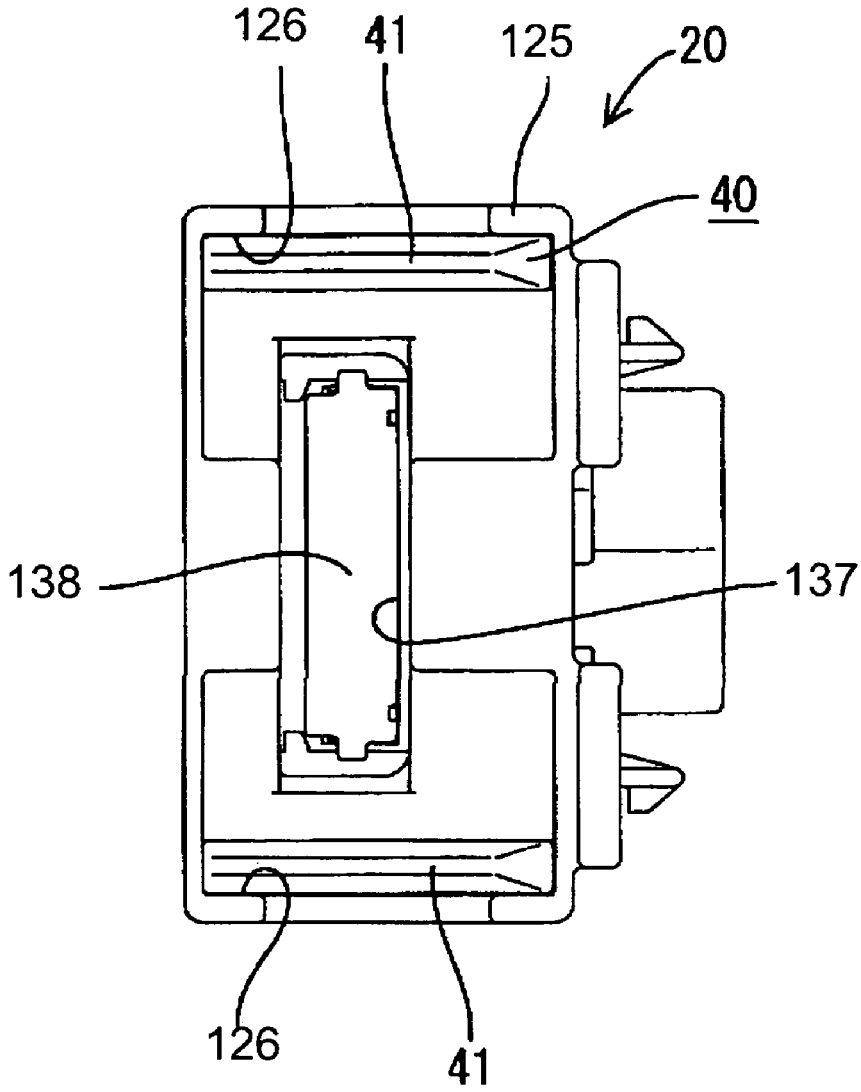
FIG. 26 is a side view of the female housing with the slider mounted at the advanced position.

A large resiliently deformable lock 136L is provided in the bottom surface of each larger cavity 28L for partly locking the large female terminal 127L. A small resiliently deformable lock 136S similarly is provided in the ceiling surface of each small cavity 28S for partly locking the small female terminal 127S. A retainer insertion hole 137 is formed in each of the left and right surfaces of the tower 21, and a retainer 138 is insertable into the retainer insertion hole 137, as shown in FIG. 26, for doubly locking the large and small female terminals 127L, 126S.

The retainer 138 can be inserted into the retainer insertion hole 137 and held at a partial locking position where locking projections 39 (only those for the small female terminals 127S are shown in FIG. 22) are before the cavities 28L, 28S. The female terminals 127L, 126S then are inserted into the corresponding cavities 128L, 127S and are pushed sufficiently to be locked by the locks 136L, 136S. The retainer 138 then is pushed a full locking position. As a result, the locking projections 39 enter the corresponding cavities 128L, 127S and engage the female terminals 127L, 126S in the cavities 128L, 127S. Thus, the female terminals 127L, 126S are locked so as not to come out.

Figure 28:
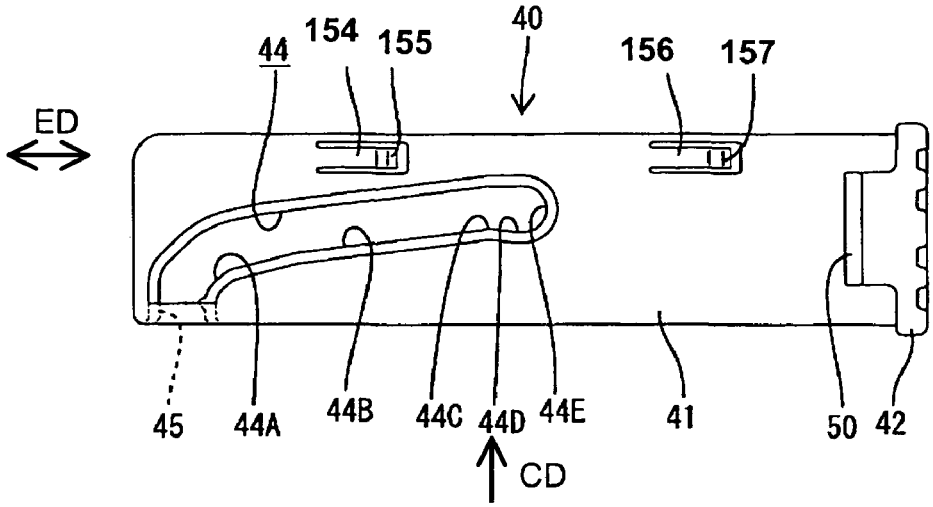
FIG. 28 is a bottom view of the slider.
Figure 29:
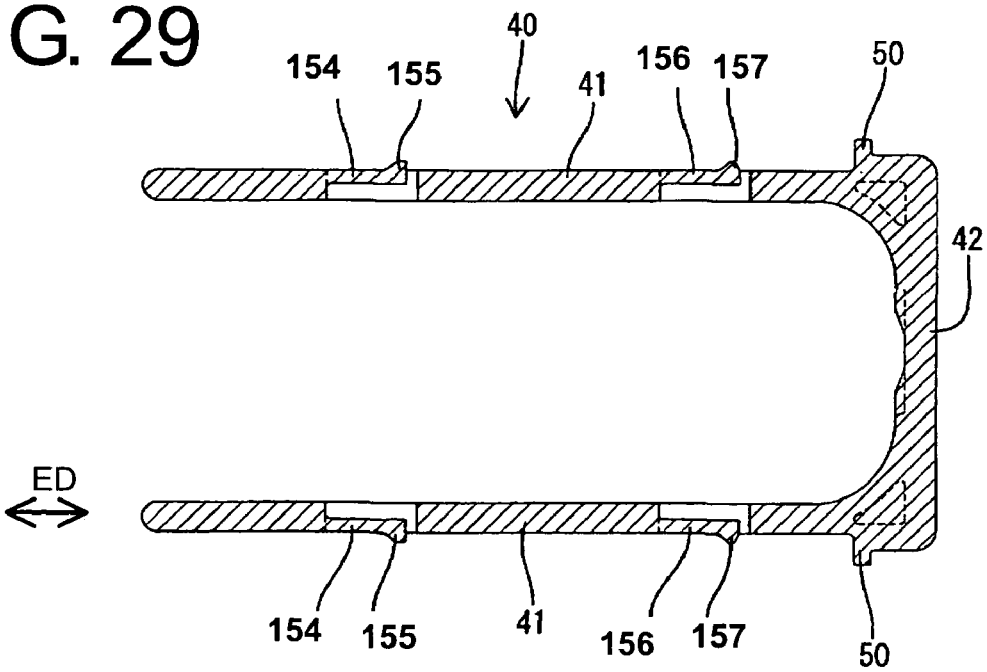
FIG. 29 is a longitudinal section of the slider.

The slider 40 is made e.g. of a synthetic resin similar to the female housing 20, but has a color different from the color of the female housing 20. As shown in FIGS. 28 and 29, the slider 40 has a gate or U-shape with two slidable portions 41 connected by a coupling plate 42. The slider 40 is mounted laterally (from either left or right side) by inserting both slidable plates 41 into the upper and lower insertion paths 126 of the female housing 20.

Each slidable plate 41 has a cam groove 44. The cam groove 44 extends from the leading end of the front edge of the slidable plate 41 substantially to a longitudinal center, and inclines gradually toward the rear edge. An entrance 45 of the cam groove 44 is open substantially at a right angle to the front edge of the slidable plate 41 and is continuous with the starting end 44A.

Follower pins 17 stand at substantially widthwise middle positions near the front edges of the upper and lower bottom surfaces of the small receptacle 12, as shown in FIGS. 21 to 23, and are engageable with the corresponding cam grooves 44. Further, an introducing hole 47 is formed substantially at a widthwise middle of a front plate 126A of each of the upper and lower insertion paths 126 of the female housing 20, as shown in FIG. 24, for permitting entry of the corresponding follower pin 17.

Figure 25:
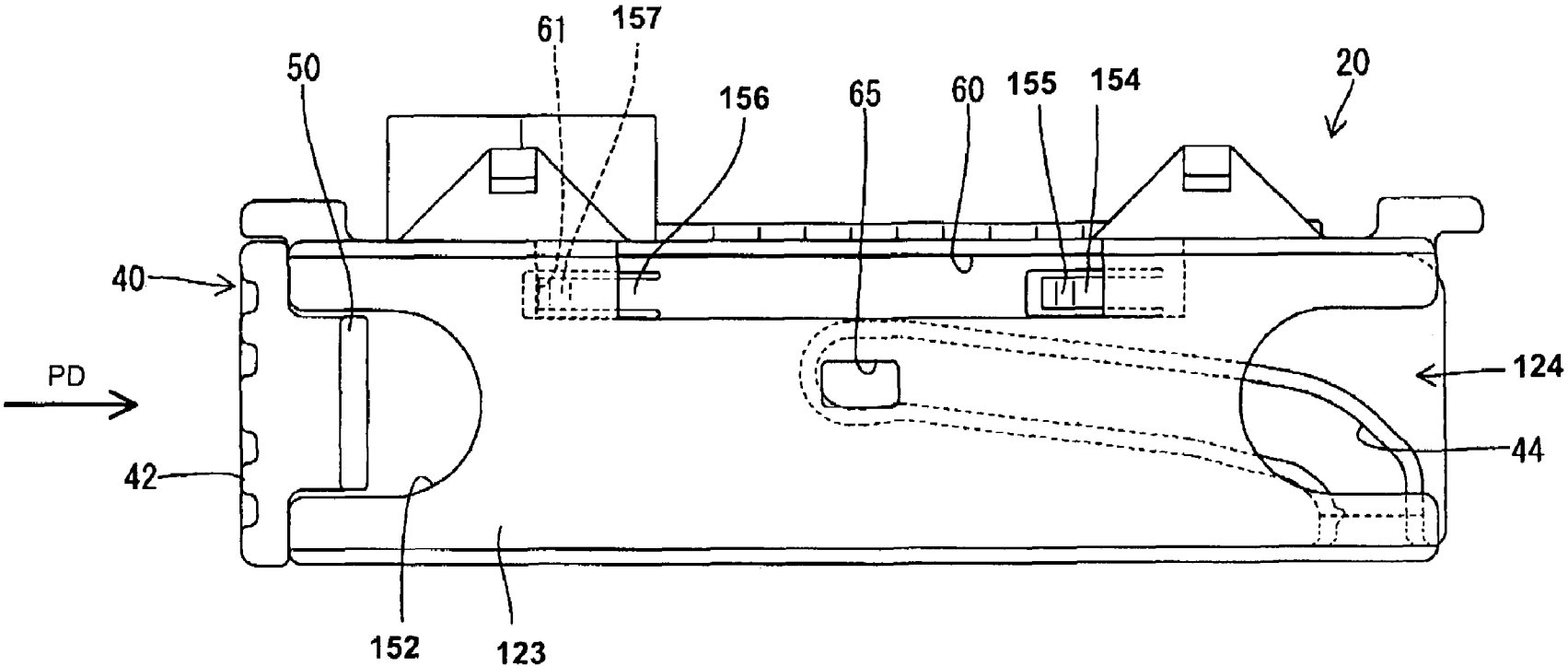
FIG. 25 is a plan view of the female housing with a slider at an advanced position.

A grip 50 is formed on the outer surface of the base end of each slidable plate 41 of the slider 40 to manipulate, insert and withdraw the slider 40. On the other hand, escape grooves 152 are formed at the opposite left and right ends of the upper and lower covers of the female housing 20, as shown in FIG. 25, for receiving the grips 50 of the slider 40.

Figure 30:
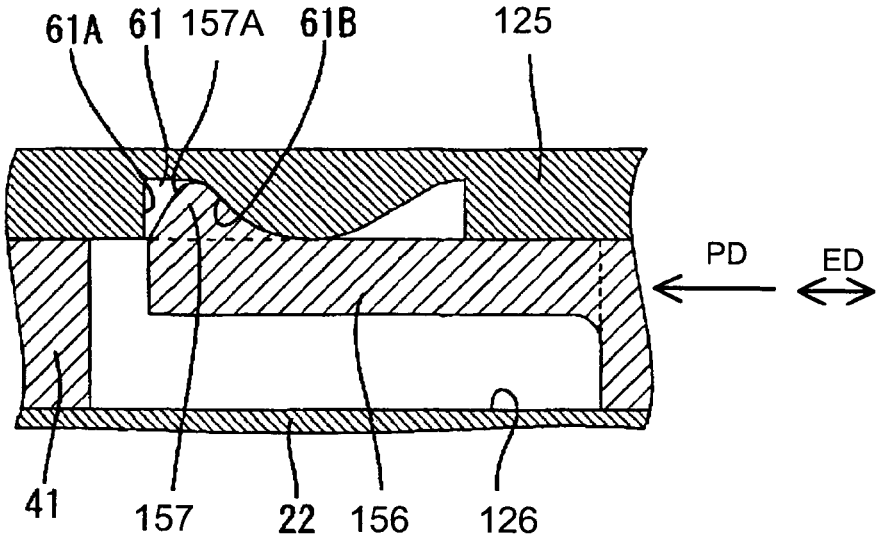
FIG. 30 is a partial enlarged section showing a state where a locking piece is engaged with a locking hole.

Each slidable plate 41 of the slider 40 has a fastening piece 154 at a position corresponding to a substantially longitudinal middle portion of the cam groove 44 and displaced toward the rear edge, as shown in FIGS. 28 and 29. The fastening pieces 154 cantilever towards the base ends of the slidable plates 41 and are resiliently deformable. Protrusions 155 are formed on the outer surfaces of the projecting ends thereof. Each slidable plate 41 also has a locking piece 156 at a position substantially in the middle between the fastening piece 154 and the coupling plate 42 and displaced toward the rear edge. The locking piece 156 cantilevers towards the base end of the slidable plate 41 and is resiliently deformable. A locking claw 157 is formed on the outer surface of the extending end of the locking piece 156. A surface of the protrusion 155 of each fastening piece 154 at its projecting end is at an angle and preferably substantially normal to an extending direction ED of the fastening piece 154. The locking claw 157 of each locking piece 156 has a slanted surface 157A that is slightly oblique to a plane normal to the extending direction ED of the fastening piece 154, as shown in FIG. 30.

Figure 27:
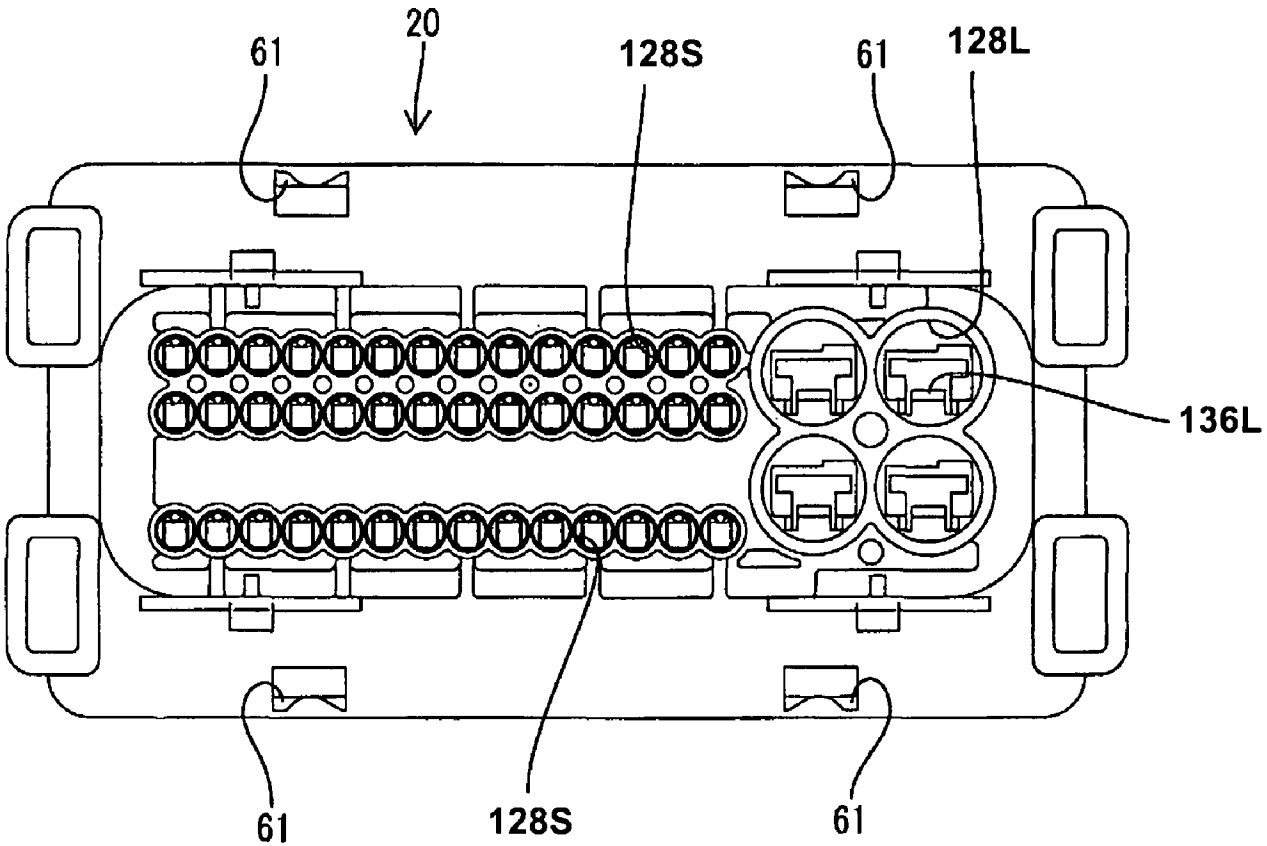
FIG. 27 is a rear view of the female housing.

A long groove 60 is formed substantially in a longitudinal middle part of each cover 125 of the female housing 20 along the rear edge thereof, as shown in FIG. 21. The protrusions 155 of the fastening pieces 154 are fit movably into the long grooves 60. Opposite ends of the long grooves 60 are closed at the outer surfaces, and locking holes 61 are formed in the inner surfaces of the closed portions, as shown in FIGS. 27 and 30, for receiving the protrusions 155 of the corresponding fastening pieces 154 and the locking claws 157 of the locking pieces 156. Opposite left and right surfaces of each locking hole 61 are formed into locking surfaces 61A that are arranged substantially normal to the pushing direction PD and the extension direction ED. Moderately rounded sloped surfaces 61B face the locking surfaces 61A.

The slidable plates 41 of the slider 40 are inserted into the insertion paths 126 of the female housing 20, for example, from the left side of FIG. 21 and the protrusions 155 of the fastening pieces 154 drop into the locking holes 61 at the left ends of the long grooves 60 in FIG. 21 to hold the slider 40 at a retracted position. At this retracted position, the entrances 45 of the cam grooves 44 align with the introducing holes 47 of the female housing 20.

The slider 40 is pushed in the pushing direction PD to an advanced position where the coupling plate 42 contacts the left surface of the female housing 20. At this advanced position, the locking claws 157 of the locking pieces 156 fit into and lock in the locking holes 61, as shown in FIG. 25. The slanted surfaces 157A of the locking claws 157 thus engage the locking surfaces 61A of the locking holes 61 to form a semi-locking construction. The locking pieces 156 will deform resiliently and disengage from the locking holes 61 if a force of a specified intensity or higher acts on the slider 40 in a direction toward the retracted position and opposite to the pushing direction PD.

Since the same functions as above are displayed in the case that the slider 40 is mounted from the right side of the female housing 20, and no repeated description is given on this case. In other words, the side from which the slider 40 is more easily insertable can be selected depending on an installed position of the connector.

Each of the upper and lower covers 125 of the female housing 20 has a confirmation window 65 for visually and/or automatically confirming whether the slider 40 is at the retracted position. Specifically, each confirmation window 65 has a substantially rectangular shape and is at a position slightly before the long groove 60 and in the longitudinal center of the cover 125, as shown in FIG. 21.

A part 167 of the back-side edge of a starting end 44A of the cam groove 44 of each slidable plate 41 is in substantially the entire corresponding confirmation window 65 only when the slider 40 is at the retracted position. When the slider 40 is before the retracted position, a part of each cam groove 44 is located in the corresponding confirmation window 65. This also applies when the slider 40 is mounted from the right side.

Figure 31:
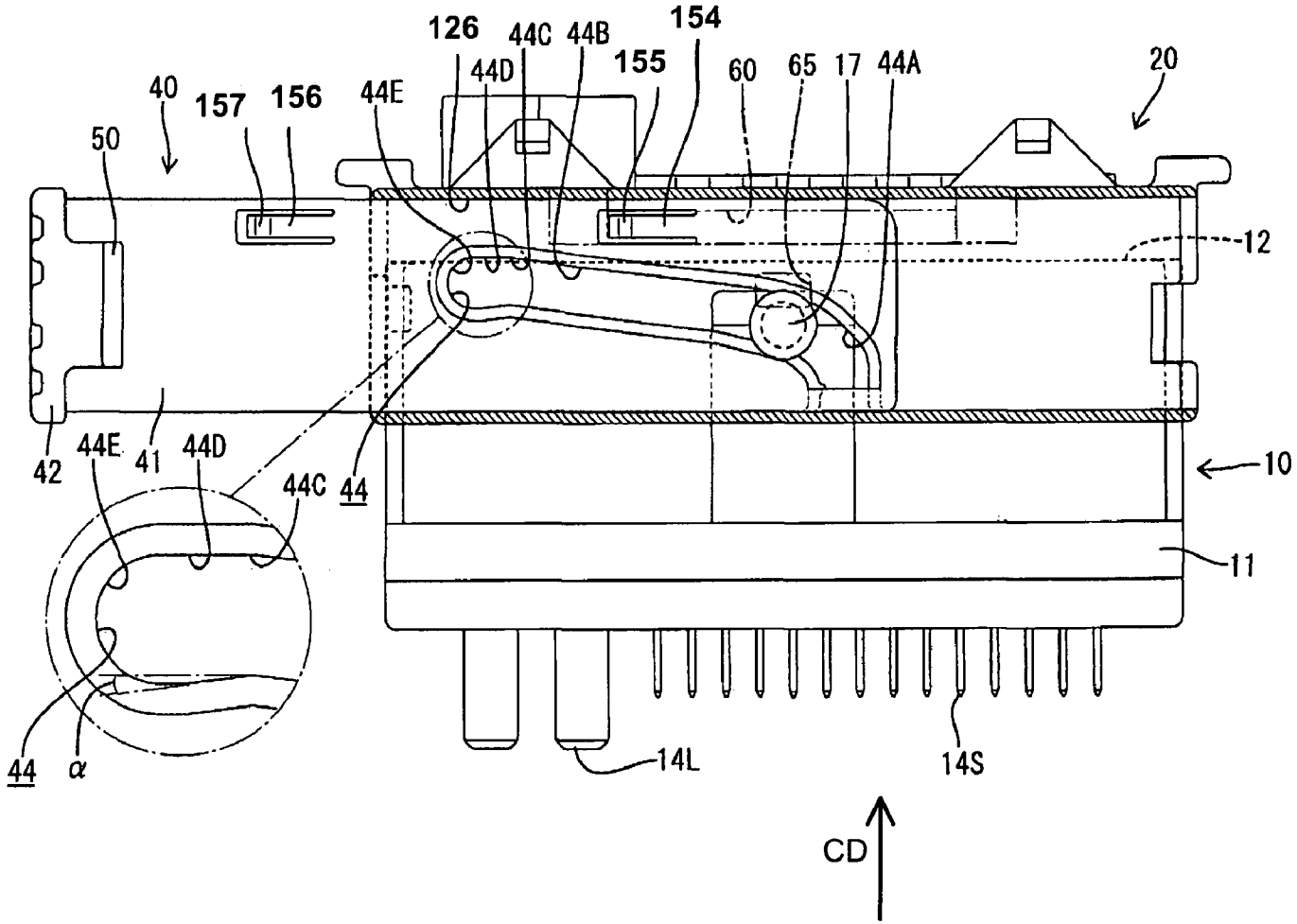
FIG. 31 is a plan view partly in section showing an initially connected state of the male and female housings.
Figure 32:
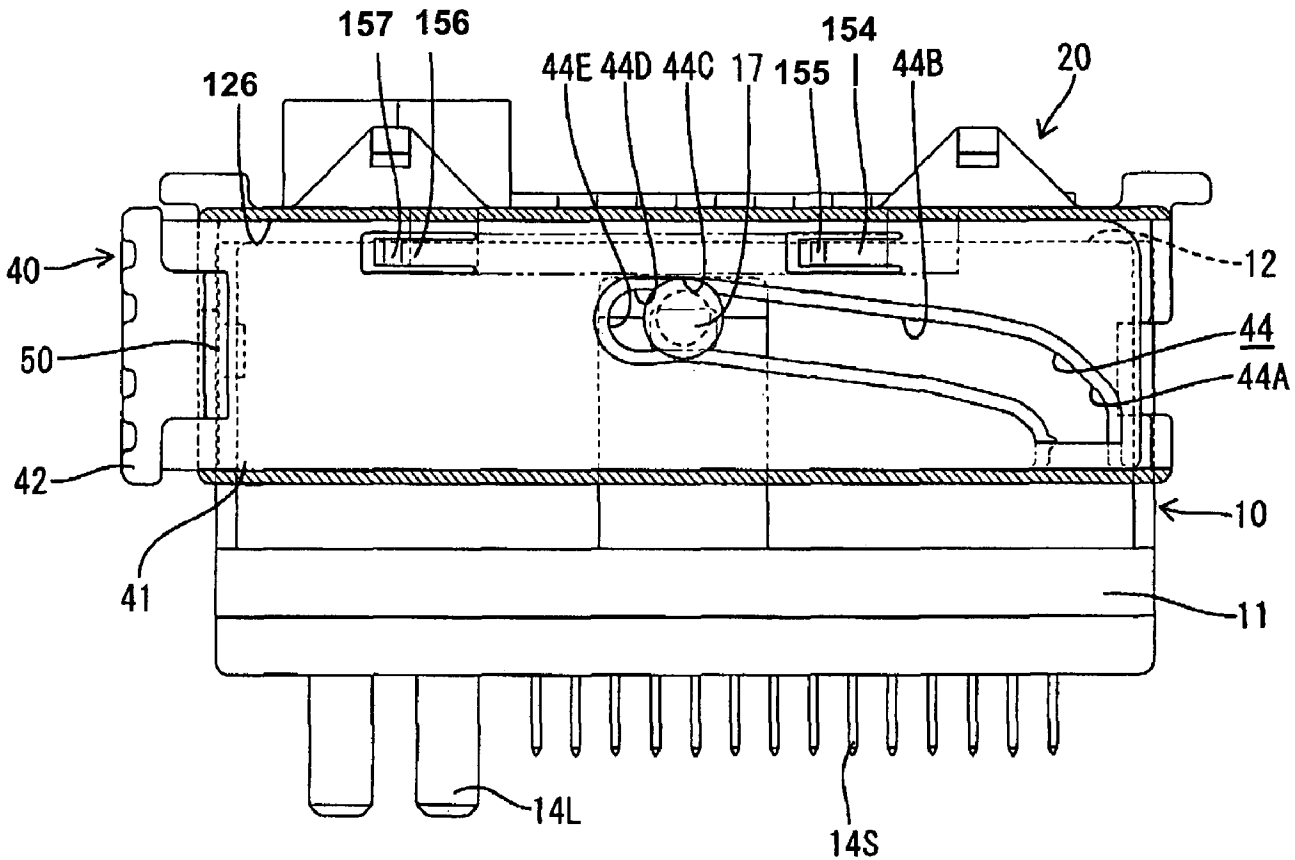
FIG. 32 is a plan view partly in section showing a state where the male and female housings are most deeply connected.
Figure 33:
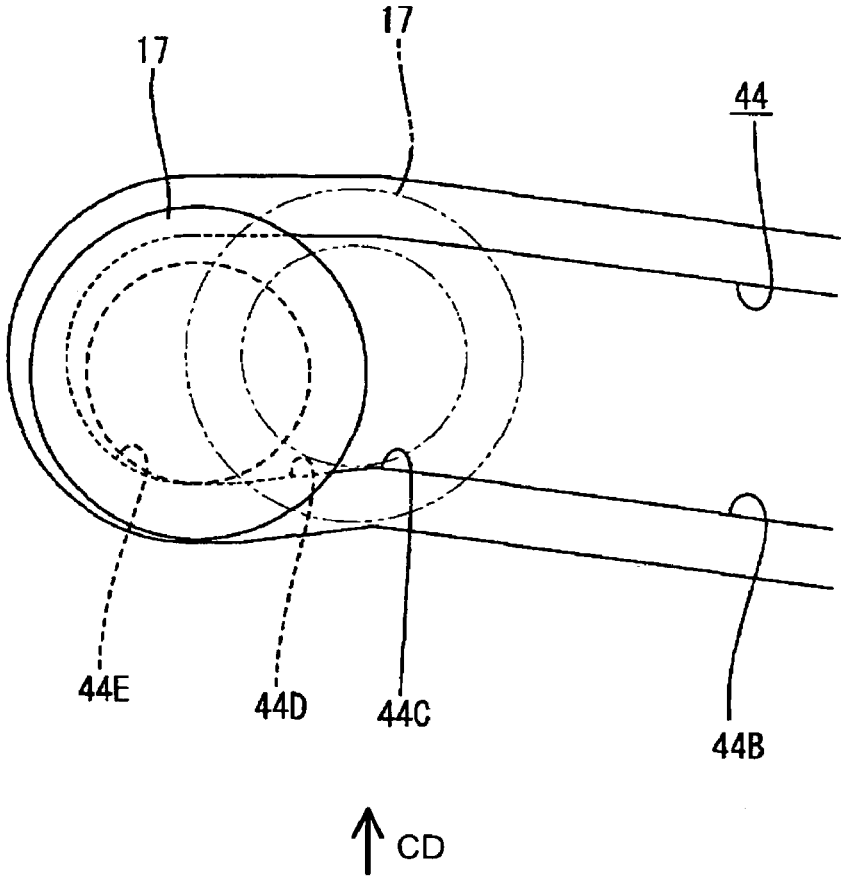
FIG. 33 is a partial enlarged plan view showing a portion of a cam groove near a terminus end.

Each cam groove 44 has a starting end 44A that is substantially continuous with the entrance 45. More particularly, the starting end 44A is slightly steep and inclined at a bigger angle with respect to the pushing direction PD than more rearward parts of the cam groove 44. A substantially straight portion 44B is substantially continuous with the starting end 44A. The straight portion 44B has a more moderate inclination with respect to the pushing direction PD than the starting end 44A and is inclined toward the rear side with respect to the connecting direction CD as it extends towards its back end. The straight portion 44B has a substantially constant inclination and makes up a large part of the cam groove 44. The rear end of the straight portion 44B is bent to define a peak 44C. A returning portion 44D is continuous with the peak 44C. The returning portion 44D is between the peak 44C and a terminus end 44E, as shown in FIG. 33. The returning portion 44D is considerably shorter than the straight portion 44B and is located very close to the terminus end 44E. Additionally, the returning portion 44D is inclined toward the front side and in a direction substantially opposite to the inclination of the straight portion 44B with respect to the connecting direction CD as it extends toward the terminus end 44E. More specifically, as shown in FIG. 31, an angle of inclination a of the front edge of the returning portion 44D is in a range from about 10° to about 5°, and preferably at about 7° to a pushing direction PD of the slider 40.

The female terminals 127L, 126S are inserted into the corresponding cavities 128L, 127S of the female housing 20 from behind, and the rear parts of the cavities 128L, 128S are closed by the rubber plugs 134. The female terminals 127L, 127S are locked doubly by the retainer 138.

The slider 40 also is mounted into the female housing 20 in advance. The slidable plates 41 of the slider 40 are inserted into the insertion paths 126, for example, from the left side of the female housing 20 and the slider 40 is pushed in the pushing direction PD to the advanced position at in a single stroke. The locking claws 157 of the locking pieces 156 are fit resiliently into the locking holes 61, as shown in FIGS. 25 and 10, to hold the slider 40 at the advanced position.

The female housing 20 preferably is transported to a site of a connecting operation with the male housing 10 while the slider 40 is at the advanced position. The slider 40 is returned to the retracted position prior to the connection of the housings 10, 20. More particularly, the upper and lower grips 50 of the slider 40 are pulled. As a result, the locking pieces 156 are guided by the slanted surfaces 157A of the locking claws 157 and deform inward to come out of the locking holes 61 and to cancel the locked state. Accordingly, the slider 40 can be pulled. In the meantime, the fastening pieces 154 are returned substantially along the long grooves 60. The slider 40 stops being pulled when the protrusions 155 engage into the locking holes 61. Thus, the slider 40 is held at the retracted position shown in FIG. 21.

The male housing 10 can be moved along the connecting direction CD and into the larger receptacle 22 of the female housing 20, as indicated by an arrow in FIG. 21, after the slider 40 has been returned to the proper retracted position. The follower pins 17 of the male housing 10 then enter the entrances 45 of the cam grooves 44 through the introducing holes 47. The male housing 10 is pushed further and the follower pins 17 push the back edges (upper edges in FIG. 31) of the starting ends 44A of the cam groove 44, as shown in FIG. 31. Thus, the slider 40 is moved by a specified distance along the inclination of the starting ends 44A toward the advanced position. As a result, the follower pins 17 enter the cam grooves 44 and are caught by the front edges of the starting ends 44A, to prevent disengagement of the male housing 10.

The slider 40 next is pushed in the pushing direction PD toward the advanced position. Thus, the follower pins 17 are displaced along the starting ends 44A and the straight portions 44B due mostly to the front edges of the cam grooves 44 pushing the follower pins 17. As a result, the male housing 10 is pulled gradually into the female housing 20. The outer peripheral surface of the seal ring 23 slides closely in sliding contact with the inner peripheral surface of the small receptacle 12 and undergoes a resilient deformation as the housings 10, 20 are connected more deeply. Thus, the inner space of the two housings 10, 20 is sealed airtight and an inner pressure gradually increases to create biasing forces acting on the housings 10, 20 in separating directions SD as the housings 10, 20 are brought closer to each other. As a result, resistance on the slider 40 increases.

The respective male terminals 14L, 14S are inserted into the terminal connecting portions 131 of the mating female terminals 127L, 127S when the housings 10, 20 are brought closer together and the resilient contact pieces are brought resiliently into sliding contact with the male terminals 14L, 14S. The two housings 10, 20 are connected most deeply when the follower pins 17 reach the peaks 44C of the cam grooves 44. At this time, the inner pressure in the housings 10, 20 reaches its maximum and, therefore, the resistance on the slider 40 also reaches its maximum (see phantom line in FIGS. 32 and 33).

The slider 40 is pushed further in this state. Thus, the follower pins 17 enter the returning portions 44D beyond the peaks 44C and are displaced toward the terminus ends 44E in the returning portions 44D. Consequently, the two housings 10, 20 are displaced gradually in separating directions SD. At this time, the biasing forces caused by the inner pressure between the two housings 10, 20 push the housings 10, 20 in separating directions SD and pull the slider 40. As a result, the resistance on the slider 40 suddenly decreases and the slider 40 is pushed to the advanced position with the addition of an inertial force. The locking claws 157 of the locking pieces 156 are fit into the locking holes 61 to lock the slider 40 in the advanced position (see FIG. 30). In this way, the follower pins 17 reach the terminus ends 44E of the cam grooves 44, as shown in FIG. 33, and the male and female housings 10, 20 are connected properly as shown in FIGS. 34 and 35.

Forces on the housings 10, 20 in separating directions SD are created, for example, by pulling forces on the wires 133, the resiliency of the sealing members between the housings 10, 20 and/or the inner pressure of the two housings 10, 20. These forces that act on the two housings 10, 20 in separating directions SD at a final stage of the connection of the two housings 10, 20 pull the slider 40, and thus prevent the slider 40 from stopping at an intermediate position without reaching the terminus end 44E.

Forces could act on the two housings 10, 20 in separating directions SD, for example, due to the wires 133 pulled backward or an increase in the inner pressure due to a temperature change with the two housings 10, 20 are connected. These forces cause the follower pins 17 to be pushed against the edges of the cam grooves 44 near the terminus ends 44E. Thus, there is no likelihood that the follower pins 17 push the slider 40 back toward the retracted position to separate the housings 10, 20.

Figure 34:
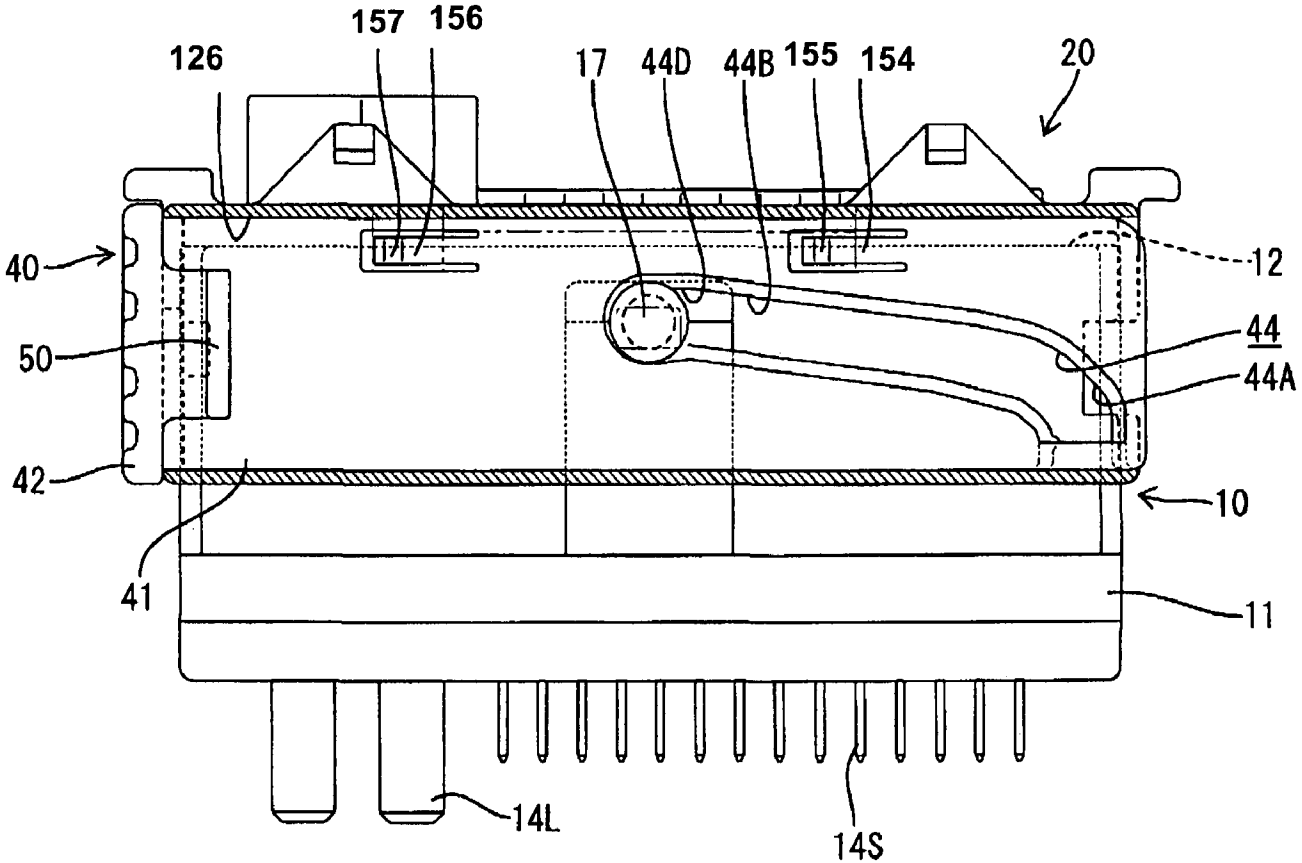
FIG. 34 is a plan view partly in section showing a properly connected state of the male and female housings.
Figure 35:
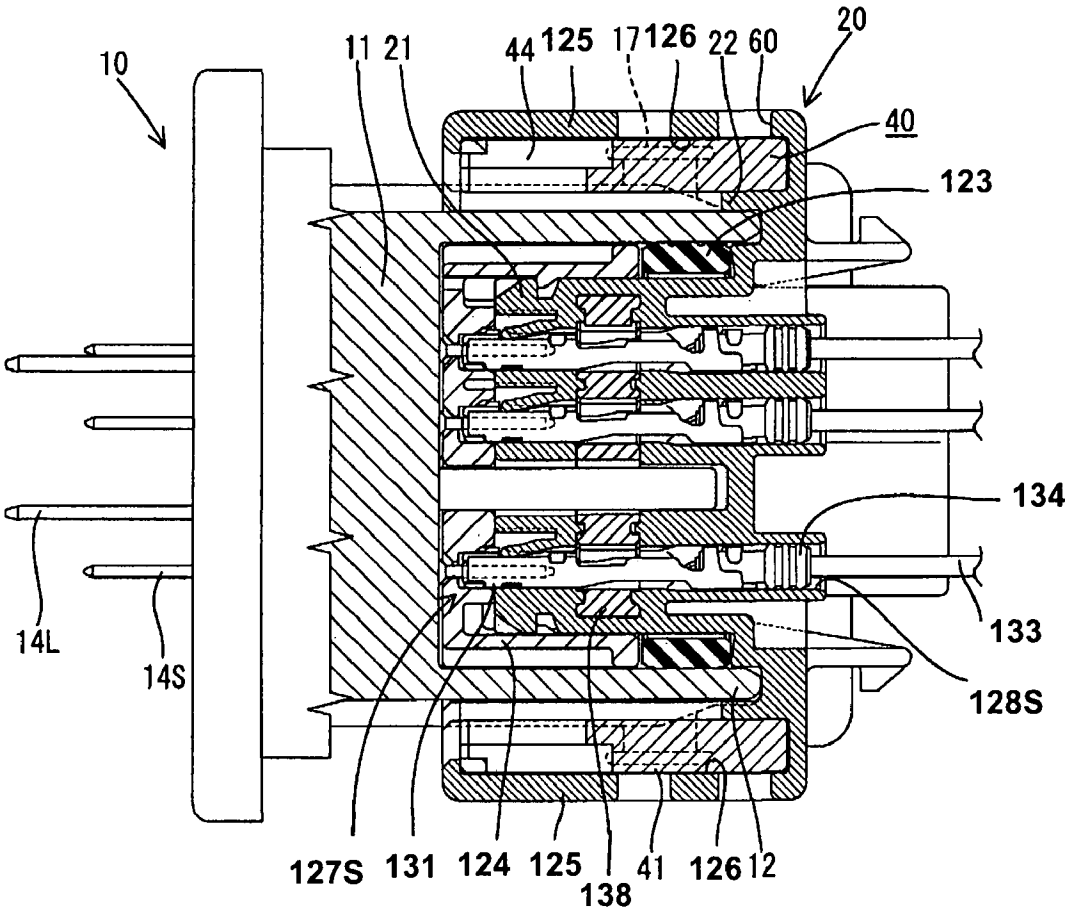
FIG. 35 is a longitudinal section showing the properly connected state of the male and female housings.
Figure 36:
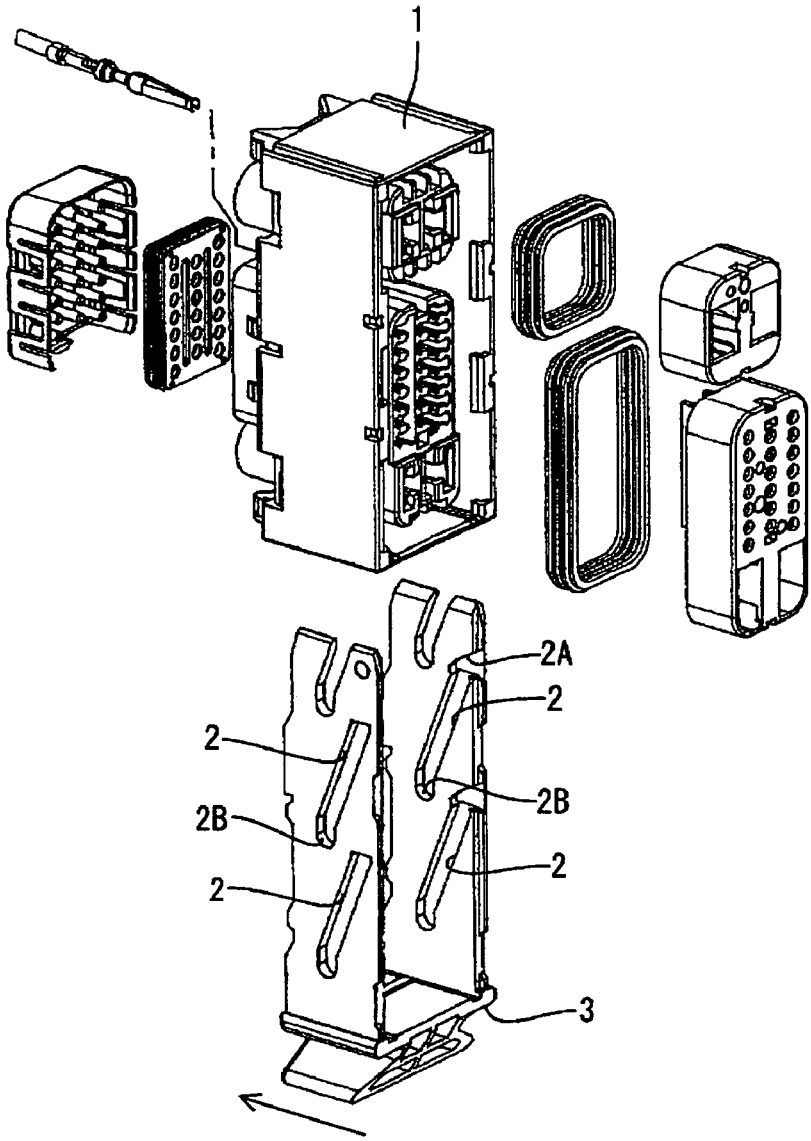
FIG. 36 PRIOR ART
FIG. 36 is an exploded perspective view of a prior art connector.

The grips 50 of the slider 40 can be pulled in the state shown in FIGS. 34 and 35 to separate the two housings 10, 20. As a result, the locking pieces 156 deform resiliently to cancel the locked state, and the slider 40 can be pulled further. The follower pins 17 then move toward the peaks 44C in the returning portions 44D of the cam grooves 44, and the two housings 10, 20 are displaced once in directions to deepen the connection. The follower pins 17 then move beyond the peaks 44C and the male housing 10 is pushed gradually out in a direction SD to separate from the female housing 20 mainly because the back edges of the cam grooves 44 push the follower pins 17. The follower pins 17 are returned to the entrances 45 of the cam grooves 44 when the slider 40 is pulled back to the retracted position. Thus, the male housing 10 can be separated from the female housing 20 while causing the follower pins 17 to exit forward through the introducing holes 47.

As described above, the returning portions 44D are near the terminus ends 44E of the cam grooves 44. Thus, forces on the housings 10, 20 in separating directions SD at the final stage of the connection of the two housings 10, 20 pull the slider 40 toward the advanced position. Therefore, the slider 40 will not stop at an intermediate position, and the two housings 10, 20 are prevented from being left only partly connected.

The two housings 10, 20 could be pulled in separating directions SD while being properly connected. However, such pulling only results in the follower pins 17 being pressed against the edges of the cam grooves 44 near the terminus ends 44E. Thus, the two housings 10, 20 are prevented from being separated by pushing back the slider 40.

The watertight connector described above results in an inner pressure that increases as the two housings 10, 20 are more deeply connected. Thus, the slider 40 is pulled with a strong force when the follower pins 17 enter the returning portions 44D at the final stage of the connection. Therefore, the slider 40 is prevented from stopping at an intermediate position.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The slider may be mounted into the male housing.

The present invention is also applicable to nonwatertight connectors.

Even though the invention has been described with reference to a slider being substantially linearly movable along the pushing direction, it should be understood that the invention is also applicable to connectors in which the cam action is displayed by a different movable member such as a rotatable or pivotable lever, a movable member movable substantially along a non-linear path, etc.

What is claimed is:

1. A connector, comprising:

a housing connectable with a mating housing along a connecting direction, the mating housing being formed with at least one follower pin;

a movable member having a front side facing in the connecting direction and an opposite rear side facing away from the connecting direction, the movable member being formed with at least one cam groove having a starting end on the front side of the movable member and a terminus end between the front and rear sides of the movable member, the movable member being mounted to the housing for movement in an operating direction intersecting the connecting direction of the housings, the cam groove being engageable with the follower pin on the mating housing and being formed such that the follower pin is displaced from the starting end to the terminus end of the cam groove as the movable member is moved in the operating direction for moving the housings to a properly connected state; and the cam groove further comprises a rearwardly inclined portion extending from the starting end towards the rear side of the movable member at an acute angle to both the operating direction and the connecting direction and a forwardly inclined returning portion extending from the rearwardly inclined portion back towards the front side of the movable member at an acute angle of inclination to both the operating direction and the connecting direction and continuing to the terminus end of the cam groove to displace the housings in separating directions as the follower pin is moved toward the terminus end in the cam groove;

wherein the cam groove comprises a peak between the inclined portion and the returning portion, the peak defining a portion of the cam groove closest to the rear side of the movable member.

2. The connector of claim 1, wherein an angle of inclination of a front edge of the returning portion is in a range from about 10° to about 5° to the operating direction of the movable member.

3. A connector assembly, comprising:

a housing and a mating housing that are connectable along a connecting direction, the mating housing being formed with at least one follower pin;

a movable member having a front side facing in the connecting direction and an opposite rear side facing away from the connecting direction, the movable member being formed with at least one cam groove having a starting end on the front side of the movable member and a terminus end between the front and rear sides of the movable member, the movable member being mounted to the housing for movement in an operating direction intersecting the connecting direction of the housings, the cam groove being engageable with the follower pin on the mating housing and being formed such that the follower pin is displaced from the starting end to the terminus end of the cam groove as the movable member is moved in the operating direction for moving the housings to a properly connected state; and the cam groove further comprises a rearwardly inclined portion extending from the starting end towards the rear side of the movable member at an acute angle to both the operating direction and the connecting direction and forwardly inclined returning portion extending from the rearwardly inclined portion back towards the front side of the movable member at an acute angle of inclination to both the operating direction and the connecting direction and continuing to the terminus end of the cam groove to displace the housings in separating directions as the follower pin is moved toward the terminus end in the cam groove;

wherein the cam groove comprises a peak between the inclined portion and the returning portion, the peak defining a portion of the cam groove closest to the rear side of the movable member.

4. The connector assembly of claim 3, further comprising means for generating biasing forces between the housings to separate the housings before the housings are connected properly.

5. The connector assembly of claim 3, further comprising at least one resilient seal configured for airtight sealing of an inner space between the housings in the properly connected state of the housings and configured for urging the housings away from one another when the follower pin align aligns with the returning portion of the cam groove, whereby the resilient seal urges the follower pin to the terminus end of the cam groove.

6. The connector assembly of claim 5, wherein an inner pressure of the inner space gradually increases to create biasing forces acting on the housings in separating directions as the housings are brought closer to each other.

7. The connector assembly of claim 6, wherein when the follower pin has reached the returning portion, the biasing forces brought about by the inner pressure between the housings urge the housings in separating directions to pull the operable member, so that resistance acting on the operable member suddenly decreases and the movable member is moved to the advanced position with an addition of an inertial force.

* * * * *